United States Patent [19]

Hattori

[11] Patent Number: 4,738,603

[45] Date of Patent: Apr. 19, 1988

[54] HYDRAULIC VANE PUMP

[75] Inventor: Katushiko Hattori, Aichi, Japan

[73] Assignee: Kabushiki Kaisha Toyota Chuo Kenkyusho, Aichi, Japan

[21] Appl. No.: 924,138

[22] Filed: Oct. 27, 1986

Related U.S. Application Data

[63] Continuation of Ser. No. 585,256, Mar. 1, 1984, abandoned.

[30] Foreign Application Priority Data

Mar. 8, 1983 [JP] Japan ..... 58-37952

[51] Int. Cl.[4] ..... F04C 18/344

[52] U.S. Cl. ..... 418/150

[58] Field of Search ..... 418/150, 259, 269

[56] References Cited

U.S. PATENT DOCUMENTS

| | | | |
|---|---|---|---|
| 2,731,919 | 1/1956 | Prendergast | 418/150 X |
| 2,791,185 | 5/1957 | Bohnhoff | 418/150 |
| 3,011,449 | 12/1961 | Ernst | 418/269 X |
| 3,565,558 | 2/1971 | Tobacman | 418/150 |
| 3,717,423 | 2/1973 | Pedersen | 418/150 |
| 3,785,758 | 1/1974 | Adams | 418/150 |
| 4,480,973 | 11/1984 | Ishizuka | 418/150 |
| 4,501,537 | 2/1985 | Ishizuka | 418/150 |

FOREIGN PATENT DOCUMENTS

| | | | |
|---|---|---|---|
| 628565 | 11/1966 | Italy | 418/269 |

*Primary Examiner*—Carlton R. Croyle
*Assistant Examiner*—Jane E. Obee
*Attorney, Agent, or Firm*—Oblon, Fisher, Spivak, McClelland & Maier

[57] ABSTRACT

A hydraulic vane which includes a housing; a cam ring disposed in the housing and having an inner peripheral surface formed in a cam curve; a drive shaft rotatably mounted in the housing; a rotor connected coaxially to the drive shaft for being driven thereby, the rotor having a plurality of vane slots defined radially in an outer peripheral wall of the rotor and fluid reservoir slots for introducing a fluid provided at the bottom of the vane slots; a plurality of vanes slidably inserted in the vane slots plurality of vane chambers defined among the rotor, the vanes and the cam ring and inlet and outlet ports defined in the housing and connected to the vane chambers wherein the maximum slanting angle of the inner peripheral surface of the cam ring in an expansion section of the cam curve has a ratio in the range of 0.9 to 1.7 to a slanting angle in an expansion section of a reference cam curve. This structure suppresses the maximum speed at which the vanes are lifted in the expansion section limit the quantity of the fluid supplied to the bottoms of the vanes to a certain range, and reduces the quantity of fluid to be supplied, thereby suppressing the ripples of the instantaneous flow discharged from the vane pump and reducing the amplitude of pressure pulsations in a discharge line of a hydraulic system.

19 Claims, 19 Drawing Sheets

HYDRAULIC VANE PUMP

This application is a continuation of application Ser. No. 585,256, filed on Mar. 1, 1984, now abanonded.

BACKGROUND OF THE INVENTION

1. Field of the Invention

The present invention relates to a hydraulic vane pump, and more particularly to the cam configuration (cam curve) to an inner peripheral surface of a cam ring of a hydraulic vane pump such as a balanced-force-type vane pump or an unbalanced-force-type vane pump.

2. Description of the Prior Art

Prior hydraulic vane pumps are subjected to variations in an instantaneous flow discharged therefrom as the rotor rotates, the flow variations being dependent on the configuration of an inner peripheral surface of a cam ring, the position and shape of inlet and outlet ports, the number of vanes used, the compressibility of a fluid being pumped, and other additional configurations. In general, with a vane pump having n vanes, the instantaneous flow undergoes n variations during one revolution of the rotor, and such variations tend to load various parts in a hydraulic system disposed downstream of the outlet port, resulting in pressure pulsations. More specifically, the pressure pulsations are caused in a discharge line by pulsating instantaneous flows discharged by the pump at periods corresponds to intervals between the vanes, and have been a major source of noises and vibrations. Conventional hydraulic vane pumps have been impossible to use in places subjected to strict environmental requirements with respect to noise and vibration. For example, a power steering pump used on an automobile has a severe standard of allowable noise or vibration, and is employed in an environment in which there are noise- or vibration-inducing conditions such as very small air bubbles contained in a fluid pumped by the power steering pump. There have heretofore been available no hydraulic vane pumps for use in such a severe environment which can meet the requirements of use.

Known hydraulic systems incorporating the conventional vane pump have had no basic arrangement for preventing noises and vibrations. A prior attempt for preventing noises and vibrations has been to reduce the volume of a vane chamber while it is in a closed state over a cam curve section corresponding to a maximum lift period or a larger-arc section before the vane chamber is opened into the outlet port, thereby compressing the fluid in the vane chamber so that the fluid pressure in the vane chamber will approach a discharge pressure. This process is known as a pre-compression method. Another attempt has been to use a resilient hose as the discharge line. Large pressure pulsations have been prevented from being propagated to a downstream side by increasing the length of the outlet pipe. The pre-compression method has been effective in reducing instantaneous flow pulsations to a small extent under the conditions in which the compressibility of the fluid being pumped is low and constant and the outlet pressure is kept constant. However, this method has proven unsatisfactory and failed to reduce the pulsations in applications where the above conditions are not present. The soft resilient discharge line or the elongated discharge line cannot achieve satisfactory pulsation reduction, and entirely fails to reduce any pulsations in the pump.

In the accompanying drawings, FIG. 1 shows a typical cam configuration of a conventional balanced-force-type vane pump in which the pre-compression method is incorporated, and FIG. 2 illustrates analyses of fluid behaviors with the cam configuration of FIG. 1. More specifically, FIG. 1 is a cam diagram of the prior vane pump. The cam configuration has one period of $\pi$ (rad), with a rotational angle $\theta$ (rad) of the rotor being indicated on an axis of abscissa and a lift L (cm) which is a vane lift length being indicated on an axis of ordinate. FIG. 2 shows in its lower side the waveform of an instantaneous flow of a discharged fluid as calculated on the basis of the above prior cam configuration with the fluid having an extremely high bulk modulus of 12,000 $Kgf/cm^2$ approximating uncompressibility, and in the upper side the waveform of a pulsating pressure of the fluid in a discharge line of arbitrary design.

As shown in FIG. 2, the instantaneous flow discharged from the prior hydraulic vane pump with the pre-compression method incorporated changes in a region B. With the region B in view, the prior hydraulic vane pump has been improved on the basis of a fundamental cam diagram design concept to reduce the pulsation of the instantaneous flow in the region B, so that flow pulsations can be reduced by precompression in the vane chamber in the large-arc section.

Conventional unbalanced-force-type vane pumps include a cam ring having a cam surface composed of an arcuate curve extending about a certain point and having the same radius of curvature. Where the center of curvature of the arc is displaced from the center of the rotor by a distance and the distance is controllable, noises and vibrations have been suppressed primarily by using many vanes which are odd in number. This is because the instantaneous flow pulsations can be reduced by odd vanes fewer in number than even vanes and the more the vanes the smaller the instantaneous flow pulsations. Since it has therefore been difficult to reduce the size of the prior unbalanced-force-type vane pumps, there are limitations on attempts to make the pump less heavy, increase the efficiency of the pump, operate the pump at higher speeds, and handle the fluid under higher pressures. The known vane pump of this type is difficult to use in applications subjected to stricter standards of noise and vibration.

Where the number of vanes used is to be reduced, say from 10 to 8 vanes, apart from the foregoing problem of pressure pulsations, the following drawbacks occur from the standpoint of the prior design standard: First, where the number of vanes were reduced, the volume of a vane chamber defined between adjacent vanes would be increased and the quantity of air bubbles trapped in the fluid in the vane chamber would be increased. If the vane chamber containing the fluid with a higher air bubble mixture ratio were pre-compressed in the large-arc section, no effect of pre-compression could be achieved. In a compression section, the amount of fluid supplied under discharge pressure into the vane chamber would be increased in the process in which the vane chamber is opened into the outlet port, with the result that an instantaneous flow would be greatly reduced in the period corresponding to a vane-to-vane interval. Secondly, if the number of vanes were reduced, the rotational angle of the rotor corresponding to an expansion section would be reduced, and the slant of the cam surface would become steeper in the expansion section, so that the vanes would be lifted at a higher speed. With the vane lifting speed increased, the flow supplied to the bottom of the vane would locally be increased to cause an increase in flow pulsations. Since the radius of curvature of the inner peripheral surface of the cam ring would be reduced, the ability of the vanes to follow the inner peripheral surface of the cam ring would become poorer, resulting in vibrations, noise, and abnormal wear due to localized separation of the vanes from the inner peripheral surface of the cam ring. For the above reasons, the number of vanes employed in vane pumps cannot be reduced to a large extent. From a technical viewpoint, the minimum number of vanes allowed has practically been ten with balanced-force-type vane pumps and seven with unbalanced-force-type vane pumps. It has been impossible to reduce the number of vanes beyond the above limits. Accordingly, the conventional vane pumps suffer from limitations on efforts to make them more lightweight, smaller in size, and less costly, and demands for vane pumps that are more lightweight, smaller in size, and less costly to construct have not been met.

SUMMARY OF THE INVENTION

Conventional hydraulic vane pumps have been constructed on the basis of a cam diagram design idea in which flow ripples are reduced only by drawing attention to the region B (FIG. 2) of the waveform of the instantaneous flow. According to a hydraulic vane pump according to the present invention, however, a cam ring is constructed on a total cam diagram design idea with an instantaneous flow waveform, a discharge pressure waveform, and the characteristics of regions A and B in the waveforms in view.

A primary object of the present invention is to provide a hydraulic vane pump which produces reduced noise and vibration.

Another object of the present invention is to provide a hydraulic vane pump which produces reduced instantaneous flow variations and discharge pressure variations.

Still another object of the present invention is to provide a hydraulic vane pump which is small in size and is lightweight.

A further object of the present invention is to provide a hydraulic vane pump having a reduced number of vanes.

Another object of the present invention is to provide a hydraulic vane pump of high durability.

A still further object of the present invention is to provide a hydraulic vane pump which requires no means for absorbing pressure pulsations.

According to the present invention, a hydraulic vane pump comprises: a housing; a cam ring disposed in the housing and having an inner peripheral surface formed in a cam curve; a drive shaft rotatably mounted in the housing; a rotor connected coaxially to the drive shaft for being driven thereby, the rotor having a plurality of vane slots defined radially in an outer peripheral wall of the rotor and fluid reservoir slots for introducing a fluid provided at the bottom of the vane slots; a plurality of vanes slidably inserted in the vane slots; vane chambers defined among the rotor, the vanes and the cam ring and inlet and outlet ports defined in the housing and connected to the vane chambers; and the ratio of maximum value of vane lift changing quantity per unit rotational angle of a 1/180 period of cam configuration, to the maximum value of vane lift, in the expansion section of the inner peripheral surface of the cam ring is in the range of 0.020 to 0.032.

The inner peripheral surface of the cam ring is formed and expressed on the basis of the cam curve which is expressed in polar form.

The cam configuration of the inner peripheral surface of the cam ring which is expressed in polar coordinates is developed to provide a cam diagram (in orthogonal form) with the abscissa indicating the rotational angle of the vanes and the ordinate indicating the distance of lift of the vanes from a minimum arc of the inner peripheral surface of the cam ring. The maximum lift changing ratio of the inner peripheral surface of the cam ring means a maximum lift increase per unit rotational angle in such a cam diagram.

The maximum vane lift changing rate is the ratio of maximum value ($\Delta Lmax$) of vane lift increasing quantity per unit rotational angle ($\Delta\theta$) of a 1/180 period of cam configuration, to the maximum value (Lmax) of vane lift, in the expansion section of said inner peripheral surface of said cam ring.

That is, the maximum vane lift changing rate $= \Delta Lmax/Lmax$ where:

- $\Delta Lmax$: The maximum value among vane lift increasing quantities ($\Delta L$) per unit rotational angle ($\Delta\theta$) in the expansion section of the inner peripheral surface of the cam ring.
- $\Delta L$: Vane lift increasing quantity. The increased value in the distance of the cam ring from the center of the cam ring (i.e., the center of rotation of the rotor).
- Lmax: The maximum value of vane lift, i.e. the value of vane lift at the end of the expansion section of the inner peripheral surface of the cam ring.
- $\Delta\theta$: Unit rotational angle around rotating center of rotor in the rotating direction of rotor, which corresponds to 1/180 period of the cam configuration (composed of 4 sections). $\Delta\theta$ is equal to 1 degree in the case of balanced type vane pump and the angle of one period of cam configuration corresponds to the half rotation of the rotor i.e. 180 degrees. It is equal to 2 degrees in the case of unbalanced type vane pump and the angle of one period of cam configuration corresponds to one rotation of the rotor i.e. 360 degrees.

With the hydraulic vane pump of the above construction, the ratio of maximum value of vane lift changing quantity per unit rotational angle ($\Delta\theta$), to the maximum value of vane lift, in the expansion section in the inner peripheral surface of the cam ring has a certain range on the basis of the foregoing total cam diagram design idea. This can suppress the maximum speed at which the vanes are lifted in the expansion zone to limit the quantity of the fluid supplied to the bottoms of the vanes to a certain range, and controls the quantity of the fluid supplied to the vane bottom for minimizing instantaneous flow ripples or pulsations. Therefore, the amplitude of pressure pulsations produced in a discharge line of a hydraulic system can be largely reduced as a whole, so that noises and vibrations can be prevented from being generated by the hydraulic system.

The inner peripheral surface of the cam ring of the hydraulic vane pump of the present invention is of such a configuration as to minimize the pulsations of the instantaneous flow discharged from the hydraulic vane pump. This can reduce the number of vanes required in the hydraulic vane pump to a minimum, with the result that the hydraulic vane pump can be smaller in size, more lightweight, and less costly to manufacture.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 4:
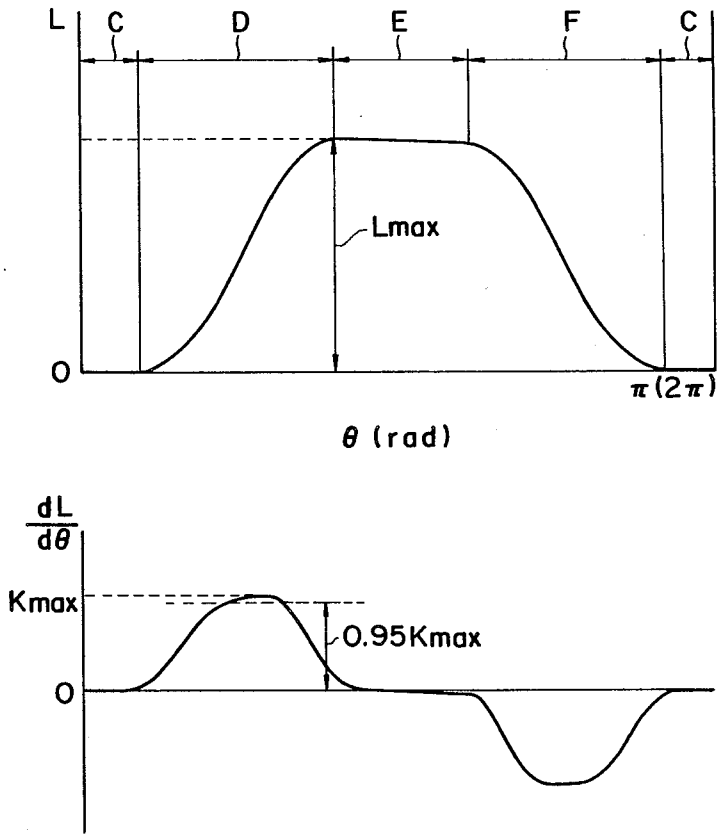
FIG. 4 is a set of fundamental lift and speed diagrams of a cam curve on an inner peripheral surface of a cam ring of a hydraulic vane pump according to the present invention.

According to the present invention, a cam curve of cam configuration formed on the inner peripheral surface of the cam ring is defined as follows: As shown in FIG. 4, the reference cam curve is composed of a small-arc section C, an expansion section D, a maximum lift holding section E, and a compression section F. These four sections are arranged in succession in the order of C-D-E-F and jointly form a minimum unit. A cam configuration extending over the minimum unit corresponds to one period of the reference cam curve.

A small-arc section is the section in which a vane is lifted from the rotor for zero or a minimum length. An expansion section is the section in which vanes slide smoothly against the inner peripheral surface of the cam ring as they are increasingly lifted. A large-arc section is the section in which a vane is lifted from the rotor for maximum length or vane lifting is slightly decreased from maximum lifting. A compression section is the section in which vanes slide against the inner peripheral surface of the cam ring as they are lowered.

The construction of a hydraulic vane pump will be described in detail with particular reference to its cam ring configuration. The instantaneous flow and pressure pulsations of the pump will also be described.

Figure 6:
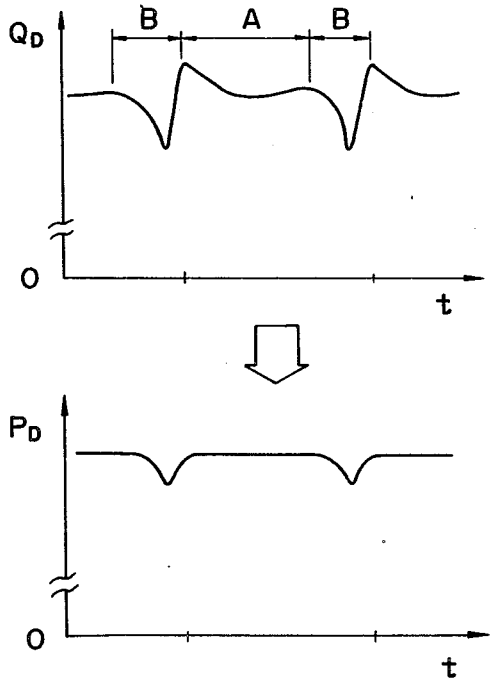
FIG. 6 is a set of diagrams showing the ripple waveforms of an instantaneous flow and a discharge pressure obtained by a typical cam curve of a hydraulic vane pump of the present invention which is suitable for use with a fluid having an extremely low bulk modulus.
Figure 5:
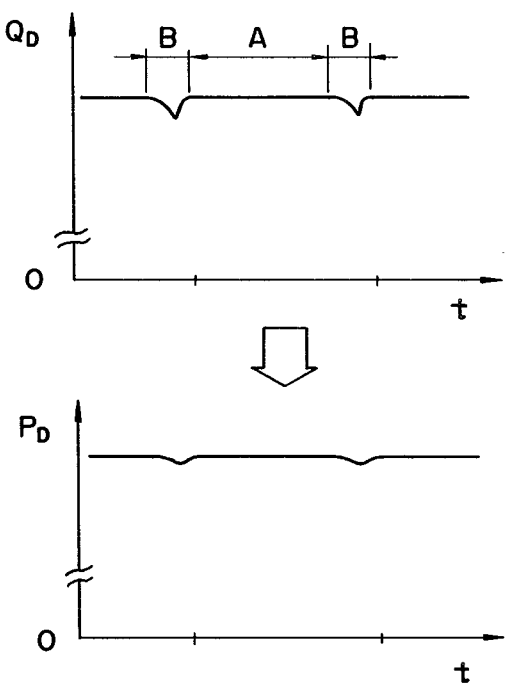
FIG. 5 is a set of diagrams showing the ripple waveforms of an instantaneous flow and a discharge pressure obtained by a typical cam curve of a hydraulic vane pump of the present invention which is suitable for use with a fluid having a relatively high bulk modulus.

The hydraulic vane pump of the invention is designed to achieve pulsation waveforms (region A) shown in FIGS. 5 and 6 while taking into consideration the characteristics of conversion of a pulsating flow produced when a fluid is discharged into a pulsating pressure. More specifically, the expansion section, particularly in a suction region, of a cam ring configuration (cam curve) as shown in FIG. 4 formed on the inner peripheral surface (cam face) of the cam ring is composed of a cam curve such as expressed primarily by an equation of higher degree, second through fifth or higher, for example, in a polar form. The ratio of maximum value of vane lifting changing quantity per unit rotational angle of a 1/180 period of cam configuration, to the maximum value of vane lift, in the expansion section of the inner peripheral surface of the cam ring is in the range of 0.020 to 0.032.

The inventor has studied hydraulic vane pumps and their flow characteristics for many years and, as a result of various experiments and theoretical analyses, has derived the following theoretical expression relating to an instantaneous flow $Q_D$ ($cm^3$/sec.) of a fluid discharged from a vane pump which is of the balanced-force type with twelve vanes:

$$Q_D = \omega b(R_4^2 - R_6^2) - 2\omega \cdot b \cdot tv \sum_{i=1}^{3} \left[ \frac{dRi}{d\theta} + \frac{1}{2}\left( \frac{dR4}{d\theta} + \frac{dR6}{d\theta} \right) \right] - 2\,Q_{LD} - Q_L \quad (1)$$

where $\omega$: the angular velocity of the rotor, b: the width of the vanes, rotor and cam ring, tv: the thickness of the vanes, Ri: the distance from the center of the cam face of an ith vane (i=1, 2, . . . 6) as counted in the direction of rotation of the rotor with a vane located in the range between a terminal end of an outlet port and a starting end of an inlet port being counted as a sixth vane, $\theta$: the rotational angle of the rotor, $Q_{LD}$: the amount of the fluid flowing or leaking into a vane chamber (here, a confining vane chamber) defined between 3rd and 4th vanes as defined above for Ri (The confining vane chamber is a chamber defined between two adjacent vanes, 3rd and 4th, when 4th or 3rd or both vane chambers are located in the maximum lift holding section), $Q_L$: the amount of other internal fluid leakage.

The pressure (Pm) in the confining vane chamber and the amount of fluid ($Q_{LD}$) flowing into the confining vane chamber have the following relationships:

$$-\omega \frac{dV_3}{d\theta} + Q_{LD} - Q_{LS} - \frac{V_3}{K} \frac{dPm}{dt} = 0 \quad (2)$$

$$Q_{LD} = \pm CAd(\theta)\sqrt{\frac{2|Pd - Pm|}{\rho}} + (Pd - Pm)\frac{La_{4\text{-}hs3}}{6\mu tv} \quad (3)$$

$$Q_{LS} = \pm CAs(\theta)\sqrt{\frac{2|Pm - Ps|}{\rho}} + (Pm - Ps)\frac{La_{3\text{-}hs3}}{6\mu tv} \quad (4)$$

where $V_3$: the volume of the confining vane chamber, $Q_{LS}$: the amount of the fluid flowing from the confining chamber into the inlet port, K: the bulk modulus of the fluid in the confining vane chamber, t: time, C: flow coefficient, Ad($\theta$): the area of opening between the confining vane chamber and the outlet port, As($\theta$): the area of opening between the confining vane chamber and the inlet port, $\rho$: the density of the fluid, $\mu$: the viscosity coefficient of the fluid, Lai: the distance such an ith vane is lifted from the rotor (i=1, 2, . . . 6), hs: the clearance between the vanes and a sidewall.

The foregoing equations have clarified the relationships between shapes of components of the hydraulic vane pump and flow characteristics. One important feature to be noted here is that in the equation (2), the amount of fluid $Q_{LD}$ is reduced by being pre-compressed as the vane is lowered in a pre-compression section of the cam configuration (as indicated by the first term) and the pressure Pm in the confining chamber is increased with a time delay since the fluid in the confining vane chamber is compressible (as indicated by the fourth term).

Figure 2:
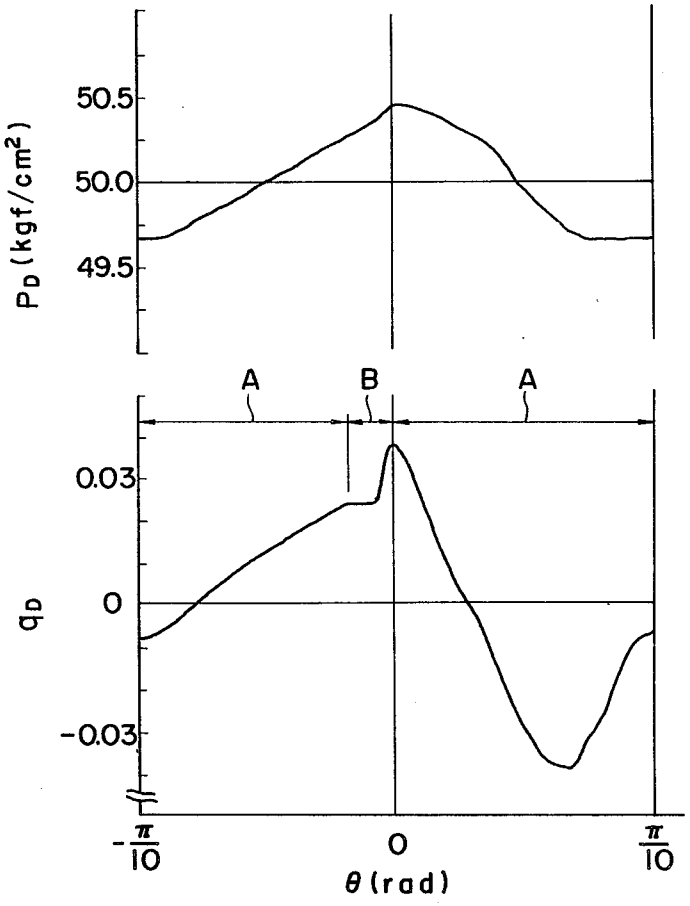
FIG. 2 PRIOR ART
FIG. 2 is a diagram showing the waveforms of an instantaneous flow and an outlet pressure of the conventional hydraulic vane pump.
Figure 1:
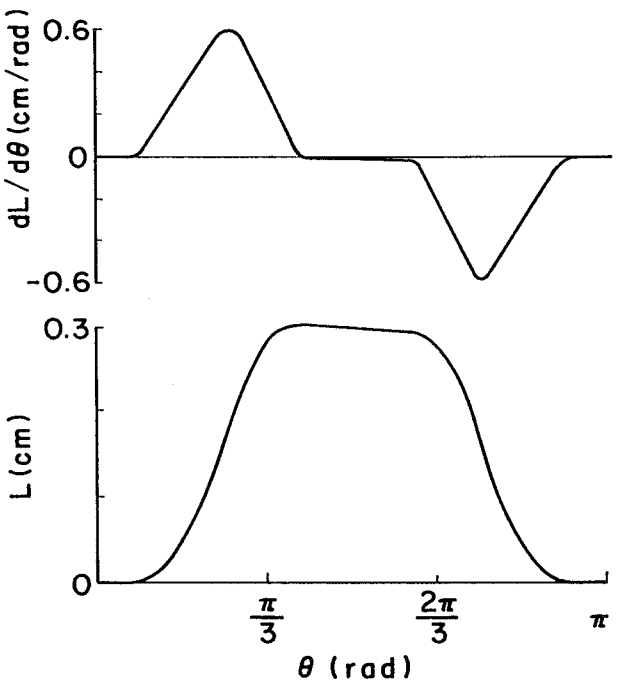
FIG. 1 PRIOR ART
FIG. 1 is a set of lift and speed diagrams of a cam curve which is a developed cam shape on an inner peripheral surface of a cam ring of a conventional hydraulic vane pump.

The differences between a design idea of two typical cam configurations as shown in FIGS. 5 and 6 according to the present invention and a design idea of a conventional cam configuration composed mainly of a constant-acceleration curve will now be analyzed using the foregoing equations with attention being drawn to an instantaneous flow of the discharged fluid. The results of the analysis are illustrated in FIGS. 2, 5 and 6. FIG. 2 shows the waveform of an instantaneous flow resulting from a cam curve composed chiefly of a conventional constant-acceleration cam and the waveform of expected discharged pressure pulsations. FIG. 5 illustrates the waveforms of a preferred instantaneous flow and expected discharged pressure pulsations, in which the instantaneous flow drops to a small extent in a region B, that is, in applications in which the bulk modulus of a fluid sucked into the hydraulic vane pump is high and the pump is used in a hydraulic system having a sufficiently large fluid reservoir with substantially no air bubbles contained in the fluid. FIG. 6 illustrates the waveforms of a preferred instantaneous flow and expected discharged pressure pulsations, in which the instantaneous flow drops to a large extent in the region B, that is, in applications in which the bulk modulus of a fluid sucked into the hydraulic vane pump is low for the reason that no sufficient large fluid reservoir can be installed and the pump is used as in automobiles in which a large quantity of air bubbles is contained in the fluid because the operating condition is unstable or the suction line of the hydraulic vane pump has something located therein which causes cavitation.

In each of the waveforms shown in FIGS. 2, 5 and 6, the region A is affected primarily by the first and second terms of the equation (1) and the region B is affected by the third term of the equation (1). The amount by which the instantaneous flow drops in the region B is affected largely by the bulk modulus of the fluid at the time when the confining vane chamber communicates with the inlet port. That is, that amount is affected by a variation in a confined pressure that is approximately determined by the relationship of the equation (2). The confined pressure variation can be improved by a notch configuration, in the maximum lift holding section, determining Ad($\theta$) in the first term of the equation (3) and a cam configuration, in the large-arc section, determining a volume variation $dV_3/d\theta$ in the confining vane chamber in the first term of the equation (2). Those hydraulic vane pumps which employ the pre-compression method among conventional hydraulic vane pumps have relied on the latter improvement to reduce the reduction in the amount of the instantaneous flow in the region B shown in FIG. 2. Although the conventional cam configuration design idea employing the precompression method only is effective to reduce the reduction in the amount of the instantaneous flow in the region B, it completely fails to improve a variation in the vicinity of the central portion of the region A, which variation will invite a large drop in the instantaneous flow due to a quantity of fluid supplied to the bottom of the vane in a suction region. Therefore, the design idea aimed at reducing the drop of the instantaneous flow in the region B only by relying on the prior pre-compression method suffers from the above drawback which remains to be solved. More specifically, the flow pulsation in the region A is mainly caused by lifting of the vane located in the expansion section of the cam configuration or the suction region. Accordingly, for improving such flow pulsation, the cam ring configuration should be designed with the characteristics in the regions A, B in view.

According to the present invention, the waveform of an instantaneous flow discharged from the hydraulic vane pump can be improved such that the waveform in the region A is rendered flat as a whole as shown in FIG. 5 or the waveform in the region A has a front portion slanting downwardly to the right and a flat rear portion as shown in FIG. 6, dependent on the condition of use or the compressibility of the fluid to be sucked into the pump. It is also possible according to the present invention to bring the waveform into conformity with a straight line connecting the starting and ending points of the waveform in the region A shown in FIG. 6 or to make the waveform convex upwardly beyond such straight line so that $Q_D$ will slightly be increased, depending on the characteristics of conversion of flow pulsations into pressure pulsations. Consequently, the hydraulic vane pump of the invention can convert pressure pulsations of a discharged fluid which are produced in a hydraulic system incoporating the hydraulic vane pump flat into a flat waveform in a region corresponding to the pressure pulsating region A to thereby reduce frequency components having a period equal to one vane-to-vane pitch or reduce pulsation amplitudes such as secondary components having a frequency twice the above frequency, and includes vanes having a good capability of following the inner peripheral surface of the cam ring.

The present invention includes the following aspects when it is put into practice.

Figure 8:
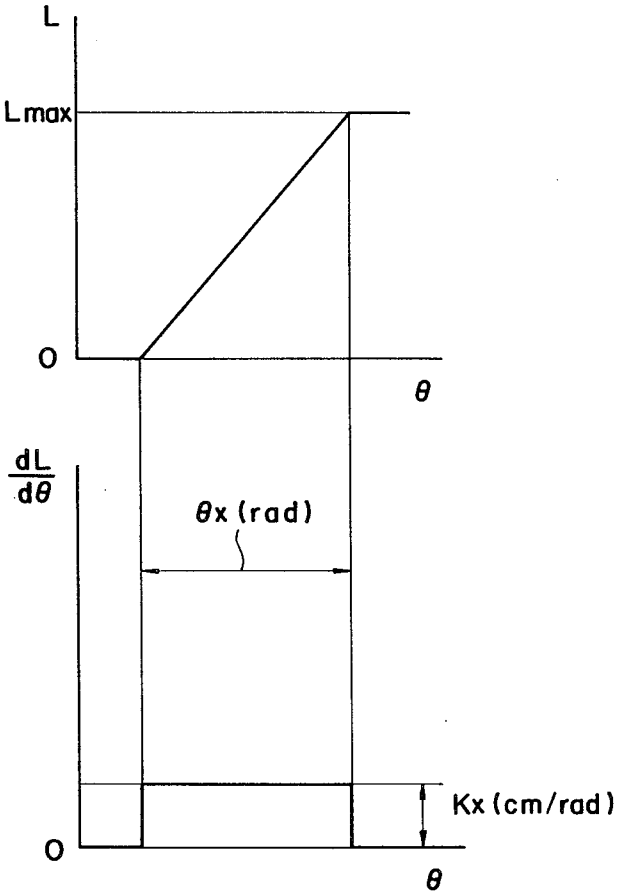
FIG. 8 is a diagram explanatory of an expansion section in a reference cam curve.
Figure 7:
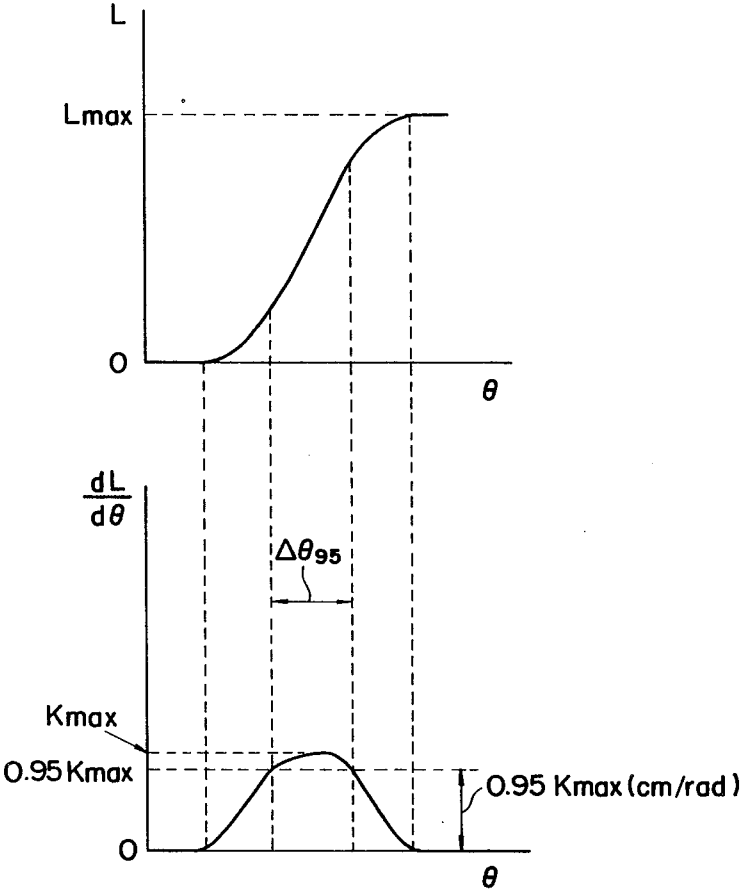
FIG. 7 is a diagram explanatory of the configuration of an expansion section of a cam curve formed on an inner peripheral surface of a cam ring of the hydralic vane pump of the present invention.

A first aspect of the present invention will be described with reference to FIGS. 7 and 8.

According to a first aspect of the present invention, the region ($\Delta\theta_{95}$) having a lift increasing amount per unit rotational angle of not less than 95% of the maximum value of vane lift changing quantity per unit rotational angle ($\theta\Delta$) in the expansion section of the inner peripheral surface of the cam ring is in the range of 5.1% to 17.5% of the rotational angle ($\theta x$) of one period of the cam configuration. Here, $\theta_{s95}=\Delta\theta_{95}/\theta_x\times 100$.

With the first aspect of the invention employing the above arrangement, the range in which the vane is lifted at a high speed is given a desired proportion to suppress a localized increase of consumption of the fluid supplied to the bottom of the vane as the rotor rotates and also to make more uniform the fluid consumption. Accordingly, the pulsation in the instantaneous flow in the region A of the instantaneous flow waveform can be reduced approximately to zero. The pressure pulsation in the discharge line is therefore substantially eliminated, thereby preventing noises and vibrations from being generated in the hydraulic system.

The reason why the region having a lift increasing amount per unit rotational angle of not less than 95% of the maximum value of vane lift changing quantity per unit rotational angle ($\theta\Delta$) in the expansion section of the inner peripheral surface of the cam ring is in the range of 5.1% to 17.5% of a rotational angle ($\theta x$) of one period of the cam configuration is that if the region were smaller than 5.1%, the maximum speed at which the vane will be lifted would be increased to locally reduce the instantaneous flow, resulting in a source of increased pulsations. The localized pulsation increase would invite an increased pressure pulsation, which would be a cause of noises and vibrations in the hydraulic system. The reason why the region is 70.5% or less is that if the region exceeded 70.5%, the speed of lifting of the vane would be reduced, but the acceleration of lifting movement of the vane would locally be increased and the force with which the vane can follow the inner peripheral surface of the cam ring would fall short or become excessive. This would cause the vane to vibrate, producing abnormal wear on the tip of the vane and the inner peripheral surface of the cam ring. The hermetically sealed condition at the tip of the vane would then be impaired to reduce the pump efficiency. In addition, noise would be produced and a pump housing would be vibrated due to successive impact sounds given off between the vane and cam ring.

The cam configuration of the hydraulic vane pump according to the first aspect of the invention will make the advantages of the first aspect more effective in conditions where the compressibility of the fluid is relatively small and the reduction of the instantaneous flow is small in the region B of the instantaneous flow waveform.

Figure 9:
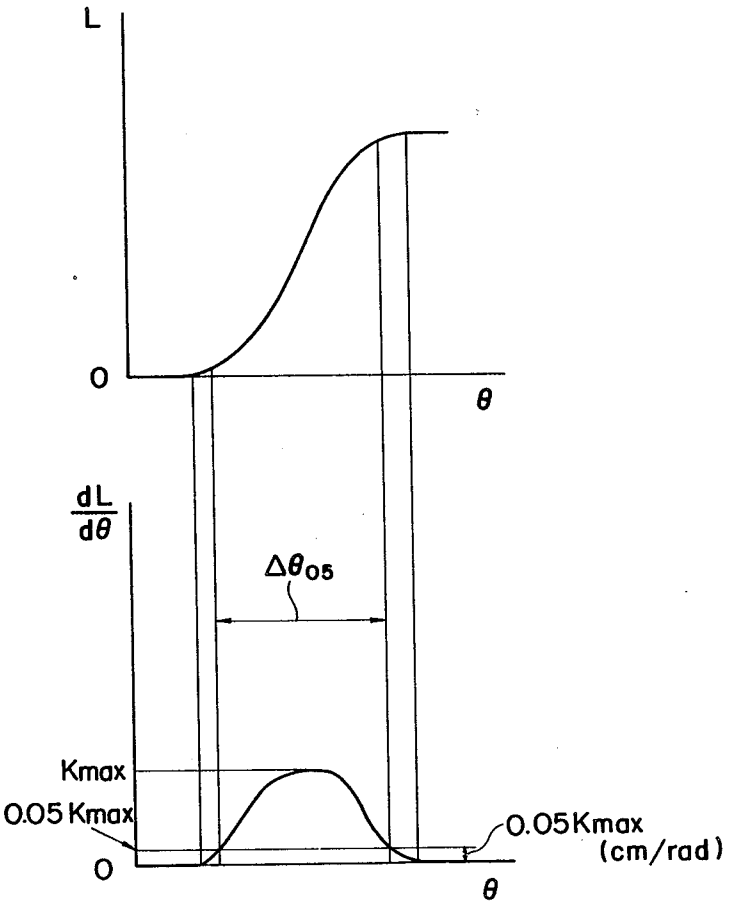

A second aspect of the present invention will be described with reference to FIGS. 8 and 9.

According to the second aspect of the present invention, the region ($\Delta\theta_{05}$) having a lift increasing amount per unit rotational angle of not less than 5% of the maximum value of vane lift changing quantity per unit rotational angle ($\theta\Delta$) in the expansion section of the inner peripheral surface of the cam ring is in the range of 25% to 35% of a rotational angle ($\theta x$) of one period of the cam configuration. Here, $\theta_{s05}=\Delta\theta_{05}/\theta_x\times 100$.

With the second aspect of the invention, the rotational angle corresponding to the expansion section in which the inner peripheral surface of the cam ring in the expansion section has a vane lift increasing quantity per unit rotational angle which is 5% or more of the maximum value of vane lift increasing quantity per unit rotational angle ($\Delta\theta$) is selected to be of as large a proportion as possible. Therefore, the lifting movement of the vane against the inner peripheral surface of the cam ring is slowed or the speed at which the vane is lifted in following the inner peripheral surface of the cam ring is lowered, with the result that any pulsations of the instantaneous flow can be reduced. By reducing the speed at which the vane slides in its vane slot or the vane lifting speed, the viscosity resistance of the fluid between the vane and its vane slot is lowered to improve the followability of the vane with respect to the inner peripheral surface of the cam ring. Since the acceleration with which the vane follows the cam surface can be lowered, the force with which the vane is pressed against the inner peripheral surface of the cam ring in a former half of the expansion section is relatively increased to prevent the vane from being separated off the inner peripheral surface of the cam ring. This can prevent noise from being produced and the pump housing from being vibrated due to successive impact sounds given off between the vane and cam ring. Any abnormal wear is also avoided on the vane. Accordingly, the frictional resistance of contact between the vane tip and the inner peripheral surface of the cam ring is prevented from being lowered and hence the pump efficiency is prevented from being lowered due to fluid leakage. The vanes and the pump will thus have an increased service life.

The reason why the region in which the inner peripheral surface of the cam ring in the expansion section has a lift increasing quantity per unit rotational angle which is 5% or more of the maximum lift increasing quantity per unit rotational angle ($\Delta\theta$) is 25% or more of the rotational angle of a 1/180 period of the cam configuration is that if the region were smaller than 25%, the speed of lifting movement of the vane would be increased as a whole to fail to reduce pulsations sufficiently, and the acceleration of lifting movement of the vane would be increased and the ability for the vane to follow the inner peripheral surface of the cam ring would be rendered poor at the joint between the small-arc section and the expansion section and the joint between the expansion section and the maximum lift holding section, conditions which are a source of noises and vibrations. The reason why the region is 35% or smaller is that if the region exceeded 35%, the small-arc section and the large-arc section or the compression section would comparatively be narrowed to render the joints between the sections inappropriate. This would allow a localized increase in the instantaneous fluid flow to bring on a pressure ripple, thus causing noises and vibrations.

According to a third aspect of the present invention, the inner peripheral surface of the cam in the maximum lift holding section has a predetermined pattern for reducing the distance that the vane is lifted by an amount which is 2 to 10% of the maximum vane lift on the average per one radian in the direction of rotation of the rotor.

Where the fluid is compressible, or it is incompressible per se but rendered compressible due to inclusion of air bubbles within a vane chamber defined between the outer peripheral surface of the rotor, the inner peripheral surface of the cam ring, and two adjacent vanes, the fluid discharged from the vane chamber is periodically consumed because of the compression of the compressible fluid resulting in instantaneous flow pulsations during the confining process in which the pressure condition of the compressible fluid is varied from a suction pressure with the fluid communicating with the inlet port to a discharge pressure with the fluid communicating with the outlet port. The fluid flow is therefore subjected to a large reduction in the region B in the instantaneous flow waveform of the discharged fluid, causing a large pressure drop extending from the region B to the region A. The large reduction of the instantaneous flow of the discharge fluid in the region B could be prevented to some degree by reducing the constant-velocity lift of the vane in the large-arc section of the conventional cam configuration. However, such reduction of the discharge flow would not be sufficient, and not be effective in avoiding the large drop of the pressure ripple in the region A.

The third aspect of the present invention provides an optimum cam configuration of the inner peripheral surface of the cam ring for minimizing fluid pressure pulsations with the fluid characteristics in the regions A and B of the instantaneous flow and discharged pressure waveforms in view.

According to the third aspect of the invention, the large-arc section of the inner peripheral surface of the cam ring is designed to reduce the vane lift by 2 to 10% of the maximum lift per one radian in the direction of rotation of the rotor.

With the above arrangement of the third aspect, the amplitude of pressure pulsations generated in the discharge line of the hydraulic system can be reduced as a whole to a large extent.

The third aspect is particularly advantageous in that it can reduce pressure pulsations of a fluid which is highly compressible or has a widely variable modulus of compressibility in the same manner as with a fluid which is incompressible or is of small compressibility.

In the third aspect of the invention, where the drop of the instantaneous flow in the region B is relatively small, the cam configuration is established such that the region A of the instantaneous flow is rendered flat. If the drop of the instantaneous flow in the region B becomes large at a high discharge pressure due to the fact that the compressibility of the fluid is large or variable and the amount of pre-compression in the large-arc section of the cam configuration is selected to be intermediate, then the cam configuration is established such that the region A has a flat rear half and a front half inclined downwardly to the right.

According to the third aspect of the present invention, when five vanes are provided in one period of the cam configuration and a V-belt is employed as a driving means, it is preferable that the inner peripheral surface of the cam ring in a large-arc section of the cam curve has an average vane lift reduction which is in the range of 6 to 10% of a maximum vane lift per one radian in the direction of rotation of the rotor.

The average vane lift reduction ($K_b$) of less than 6%, will cause the torque variation of the vane pump itself, resulting in the variation of rotation of the pump axis. This will bring the flow pulsation and hence the pressure pulsation in the discharge line, thus causing noises and vibration.

If the pressure pulsation at the region A cannot be reduced enough even with $K_b$ set in the range of 6 to 10%, it is preferable that the region ($\Delta\theta_{05}$) having a lift increasing amount per unit rotational angle which is 5% or more of the maximum value of vane lift changing quantity per unit rotational angle ($\theta\Delta$) of the inner peripheral surface of the cam ring in the expansion section of the cam curve is in the range of 90 to 98%. Within this range, the pressure pulsation at the region A can be minimized.

In cases except the above, $K_b$ may be in the range of 2 to 6%, and the region ($\Delta\theta_{05}$) may be in the range of 98 to 140%.

According to a fourth aspect of the present invention, five vanes are provided in one period of the cam configuration, and the ratio of maximum value of vane lift changing quality per unit rotational angle of a 1/180 period of cam configuration, to the maximum value of vane lift, in the expansion section of the inner peripheral surface of the cam ring is in the range of 0.022 to 0.032.

With the hydraulic vane pump thus constructed according to the fourth aspect, the cam ring can be best suited in configuration to the hydraulic vane pump having five vanes in one period of the cam configuration. By limiting the maximum speed at which the vane will be lifted in the expansion section in wider conditions of use, discharged flow ripple can be reduced and minimized to thereby reduce flow and pressure pulsations in the discharge line. Accordingly, noise and vibration that would be generated in the hydraulic system primarily around the hydraulic pump can be greatly reduced.

According to the fourth aspect of the invention, the ratio of maximum value of vane lift changing quantity per unit rotational angle of a 1/180 period of cam configuration, to the maximum value of vane lift, in the expansion section of the inner peripheral surface of the cam ring is selected to be 0.022 or greater for the reason that if the ratio were less than 0.022, the discharged flow supplied to the bottom of the vane in the expansion section could not be rendered constant and the amplitude of ripples would locally be increased in the one pitch range of vanes. The rate is also selected to be 0.032 or smaller for the reason that if it were greater than 0.032, the discharged flow supplied to the bottom of the vane in the expansion section would be subjected to the same variation as if the ratio were less than 0.022, resulting in large localized pulsations. More specifically, with the hydraulic vane pump having five vanes in one period of the cam configuration, one or two vanes will be located in the expansion section dependent on the angular position of the rotor in ordinary cases. For keeping constant the discharged flow supplied to the bottom of the vane, it is necessary that the cam be shaped to make the discharged fluid supplied to the vane bottom constant at all times irrespectively of whether one or two vanes are present in the expansion section. By providing a desired slanting distribution in the expansion section according to the fourth aspect of the invention, pulsations can be reduced to a greater extent.

According to a fifth aspect of the present invention, four vanes are provided in one period of the cam configuration, and the ratio of maximum value of vane lift changing quantity per unit rotational angle of a 1/180 period of cam configuration, to the maximum value of vane lift, in the expansion section of the inner peripheral surface of the cam ring is in the range of 0.020 to 0.031.

With the hydraulic vane pump thus constructed according to the fifth aspect, the cam ring can be best suited in configuration to the hydraulic vane pump having four vanes in one period of the cam configuration. By suppressing the maximum speed at which the vane will be lifted in the expansion section in wider conditions of use, instantaneous flow ripples can be reduced and minimized to thereby reduce flow and pressure pulsations in the discharge line. Accordingly, noise and vibration that would be generated in the hydraulic system primarily around the hydraulic pump can be greatly reduced.

According to the fifth aspect of the invention, the ratio of maximum value of vane lift changing quantity per unit rotational angle of a 1/180 period of cam configuration, to the maximum value of vane lift, in the expansion section of the inner peripheral surface of the cam ring is selected to be 0.020 or greater for the reason that if the ratio were less than 0.020, the expansion section would necessarily be wider, and hence the small-arc section and the large arc section or the compression section would be narrowed, inviting an increased flow pulsation. The ratio is also selected to be 0.031 or smaller for the reason that if it were greater than 0.031 pulsations would locally become larger and the maximum speed of lifting movement of the vane would be increased. More specifically, with the hydraulic vane pump having four vanes in one period of the cam configuration, only one vane will be ordinarily located in the expansion section. Because the discharged flow supplied to the vane bottom is determined by the speed of lifting movement of the vane in the range in the expansion section, the expansion section should preferably be expressed in as much of a constant-velocity cam diagram as possible. Therefore, a more suitable cam configuration is such that the expansion and small-arc sections and the large-arc section are joined by a round and smooth joint not to allow the acceleration of lifting movement of the vane to disturb the followability of the vane, and the expansion section has a central portion tilted to make the speed constant. Such a cam configuration is effective in reducing pulsations to a greater extent.

Figure 10:
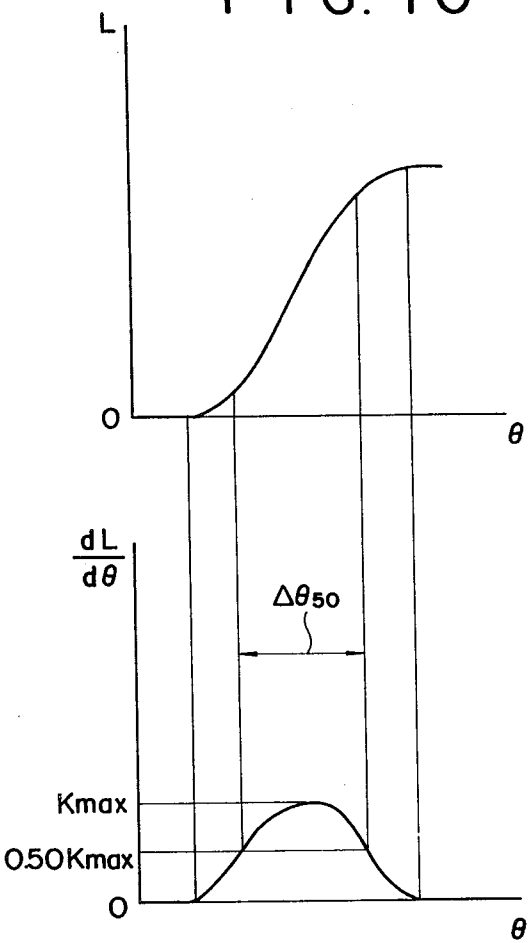
FIGS. 9 and 10 are diagrams illustrative of the expansion section of the cam curve on the inner peripheral surface of the cam ring of the hydraulic vane pump of the present invention.

A sixth aspect of the present invention will be described with reference to FIGS. 7, 8 and 10.

According to the sixth aspect of the present invention, five vanes are provided in one period of the cam configuration, the region ($\Delta\theta_{95}$) having a lift increasing amount per unit rotational angle of not less than 95% of the maximum value of vane lift changing quantity per unit rotational angle ($\theta\Delta$) in the expansion section of the inner peripheral surface of the cam ring is in the range of 5.7% to 12.0% of a rotational angle ($\theta$x) of one period of the cam configuration, and the region ($\Delta\theta_{50}$) having a lift increasing amount per unit rotational angle of not less than 50% of the maximum value of vane lift changing quantity per unit rotational angle ($\Delta\Delta$) in the expansion section of the inner peripheral surface of the cam ring is in the range of 17.1% to 22.5% of a rotational angle ($\theta$x) of one period of the cam configuration.

Where the fluid is highly compressible or it is not highly compressible per se but rendered virtually highly compressible as by air bubbles contained therein, it hsa been extremely difficult to reduce instantaneous flow pulsations and accompanying discharge pressure pulsations. The sixth aspect of the present invention provides a cam ring for minimizing pressure pulsations of a discharged fluid in a hydraulic vane pump having five vanes in one period of the cam configuration.

With the above arrangement of the sixth aspect, the maximum lifting speed of the vane in the expansion section of the cam configuration is reduced to a desired speed, and the range in which the lifting speed of the vane is high and the range which is ½ of the maximum lifting speed of the vane are brought into a desired proportion, thus reducing or substantially eliminating flow and pressure pulsations. Accordingly, noises and vibrations can be prevented which would otherwise be generated in the hydraulic system.

According to the sixth aspect, any pulsations can be greatly reduced regardless of the compressibility of the fluid drawn into the vane chamber, so that noises and vibrations in the hydraulic system composed of the pump, piping and load can completely be eliminated without increasing the cost for wider conditions of use.

The reason why the numerical values of the sixth aspect are limited to the above range is that if they were outside of the range, the amount of consumption of the fluid supplied to the vane bottom in the expansion section would become irregular, resulting in a large source of pulsations.

In this case, when the region ($\Delta\theta_{50}$) having a lift increasing amount per unit rotational angle which is 50% or more of the maximum value of vane lift changing quantity per unit rotational angle ($\theta\Delta$) of the inner peripheral surface of the cam ring in the expansion section of the cam curve is in the range of 57 to 75%, the pressure pulsation of a discharged fluid from a hydraulic vane pump can be reduced.

If the inner peripheral surace of the cam ring in a maximum lift holding section of the cam curve has an average vane lift reduction in the range of 6 to 10% of a maximum vane lift per one radian in the direction of rotation of the rotor, the pressure pulsation at the region A cannot be reduced enough. Thus it is preferable that the region ($\Delta\theta_{50}$) is set to be in the range of 50 to 57% in this case, thus enabling to reduce the pressure pulsation of a discharged fluid.

A seventh aspect of the present invention will now be described with reference to FIGS. 7, 8 and 9.

According to the seventh aspect of the present invention, four vanes are provided in one period of the cam configuration, the region ($\Delta\theta_{95}$) having a lift increasing amount per unit rotational angle of not less than 95% of the maximum value of vane lift changing quantity per unit rotational angle ($\theta\Delta$) in the expansion section of the inner peripheral surface of the cam ring is in the range of 7.5% to 13.75% of a rotational angle ($\theta$x) of one period of the cam configuration, and the region ($\Delta\theta_{05}$) having a lift increasing amount per unit rotational angle of not less than 5% of the maximum value of vane lift changing quantity per unit rotational angle ($\theta\Delta$) in the expansion section of the inner peripheral surface of the cam ring is in the range of 25.0% to 35.0% of a rotational angle ($\theta$x) of one period of the cam configuration.

With the above construction of the seventh aspect, the cam diagram is closer to a constant-velocity cam diagram and the expansion section is wider than the ordinary expansion section, thus reducing instantaneous flow pulsations. Since the vane can follow the inner peripheral surface of the cam ring more smoothly, the vane is prevented from being separated off the inner peripheral surface of the cam ring. The resulting hydraulic vane pump is of a high efficiency, is low in cost, has low noise, and has low vibrations.

The reason why the numerical values of the seventh aspect are limited to the above range is that if they were outside of the range, the ability of the vane to follow the inner peripheral surface of the cam ring in the expansion section would be very impaired, with resulting various drawbacks such as separation of the vane from the inner peripheral surface of the cam ring, noise and vibration accompanying such vane separation, fluid leakage, and abnormal wear on the vane tip and the inner peripheral surface of the cam ring.

Figure 11:
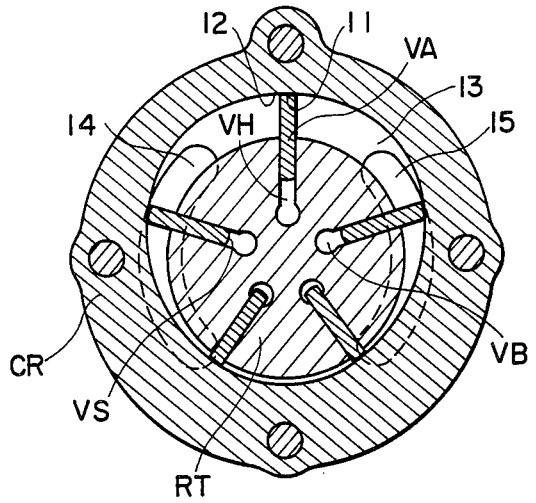
FIGS. 11 through 13 illustrate a hydraulic vane pump according to a first embodiment of the present invention, FIG. 11 being a transverse cross-sectional view of the hydraulic vane pump, FIG. 12 a set of lift and speed diagrams of a cam curve of the pump, and FIG. 13 a diagram showing the waveforms of an instantaneous flow and an outlet pressure of the pump.

A hydraulic vane pump according to a first embodiment which relates to the first aspect of the present invention will be described with reference to FIGS. 11 through 13.

According to the first embodiment, the present invention is applied to an unbalanced-force-type hydraulic vane pump for industrial use including a cam ring having an inner peripheral surface shaped such that the ratio (Ks) of maximum value of vane lift changing quantity per unit rotational angle of a 1/180 period of cam configuration, to the maximum value of vane lift, in the expansion section of the inner peripheral surface of the cam ring is 0.030, and the region ($\Delta\theta_{95}$) having a lift increasing amount per unit rotational angle of not less than 95% of the maximum value of vane lift changing quantity per unit rotational angle ($\Delta\theta$) in the expansion section of the inner peripheral surface of the cam ring is in the range of 6.93% of a rotational angle ($\theta$x) of one period of the cam configuration.

The construction, operation and advantages of the hydraulic vane pump according to the first embodiment will be described in detail with particular reference to the configuration of the cam ring.

The hydraulic vane pump according to the first embodiment includes a drive shaft (not shown) rotatably supported in a bearing (not shown) mounted in a housing (not shown), a rotor RT disposed coaxially on the drive shaft for rotation therewith, and a cam ring CR fixedly mounted in the housing in surrounding relation to the rotor.

The rotor RT has in an outer peripheral wall five radial vane slots VH. Vanes VA are disposed respectively in the radial vane slots VH. The vanes VA can be lifted into contact with an inner peripheral surface of the cam ring CR under centrifugal forces acting on the vanes VA upon rotation of the rotor and hydraulic forces acting on vane bottoms VS due to a hydraulic pump discharge pressure led into fluid reservoir slots VB. The vanes have tip ends 11 rotatable with the rotor RT along the inner peripheral surface 12 of the cam ring.

The rotor RT, each pair of adjacent vanes, the cam ring CR, and a side plate (not shown) jointly define a space or vane chamber 13 having a volume which is alternately expanded and compressed in one cycle during one revolution of the drive shaft. The side plate has an inlet port 14 positioned for communication with the vane chamber 13 in its expansion stroke, and an outlet port 15 positioned for communication with the vane chamber in its compression stroke. The vane chamber 13 opens into the inlet port 14 to suck a fluid therefrom in the expansion stroke, and opens into the outlet port 15 to discharge the fluid thereinto the compression stroke.

The inner peripheral surface of the cam ring CR has a cam curve formed thereon and having a configuration expressed by a plurality of equations of higher degrees in the expansion section so that an instantaneous flow produced when the fluid is discharged will have a waveform as shown in FIG. 5.

More specifically, the cam curve formed on the inner peripheral surface of the cam ring of the hydraulic vane pump according to the first embodiment has a configuration such that the ratio of maximum value of vane lift changing quantity per unit rotational angle of a 1/180 period of cam configuration, to the maximum value of vane lift, in the expansion section is 0.030, that is, the ratio of a maximum vane lift increase per one degree of rotational angle of the rotor to the maximum vane lift is 0.015, and the region having a lift increasing amount per unit rotational angle of not less than 95% of the maximum value of vane lift changing quantity per unit rotational angle ($\theta\Delta$) in the expansion section of the inner peripheral surface of the cam ring is in the range of 6.93% of a rotational angle ($\theta$x) of one period of the cam configuration.

With this construction, the maximum lifting speed of the vane in the expansion section of the cam configuration is suppressed, and the range in which the vane lifting speed is high is selected to be of a desired proportion so that a localized increase of consumption of the discharged fluid supplied into the vane bottom is reduced for more uniform consumption of the fluid.

According to the first embodiment, as is apparent from the foregoing, since the consumption of the discharged fluid supplied into the vane bottom, is reduced, flow and pressure pulsations of the fluid discharged from the hydraulic vane pump can be reduced to an extremely small extent, thereby preventing a hydraulic system from producing noises and vibrations. There can thus be provided an unbalanced-force-type vane pump which is small in size, lightweight, and of a low cost. In addition, such a hydraulic vane pump can improve working environments for workers working in factories and prevent labor accidents such as hardness of hearing.

Where the fluid to be sucked into the vane pump has a bulk modulus ($K_0$) which is relatively high in the range of 1,200 to 16,000 kgf/cm$^2$, the hydraulic vane pump of the first embodiment has better advantages.

Figure 12:
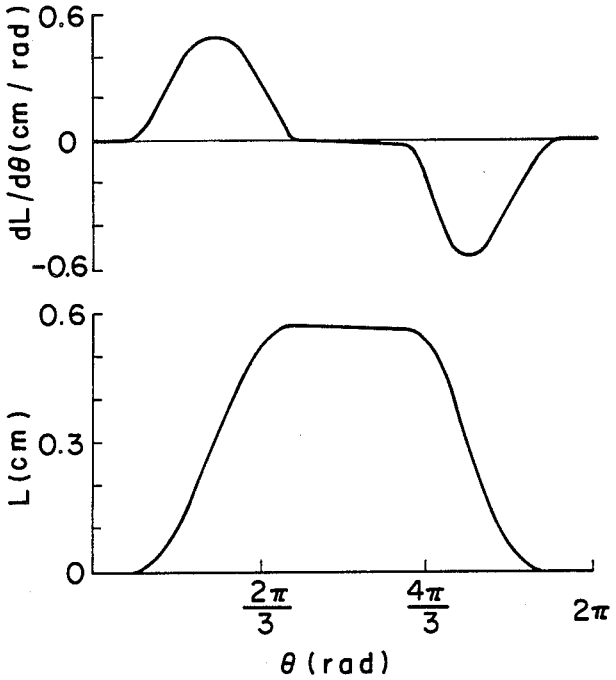
Figure 14:
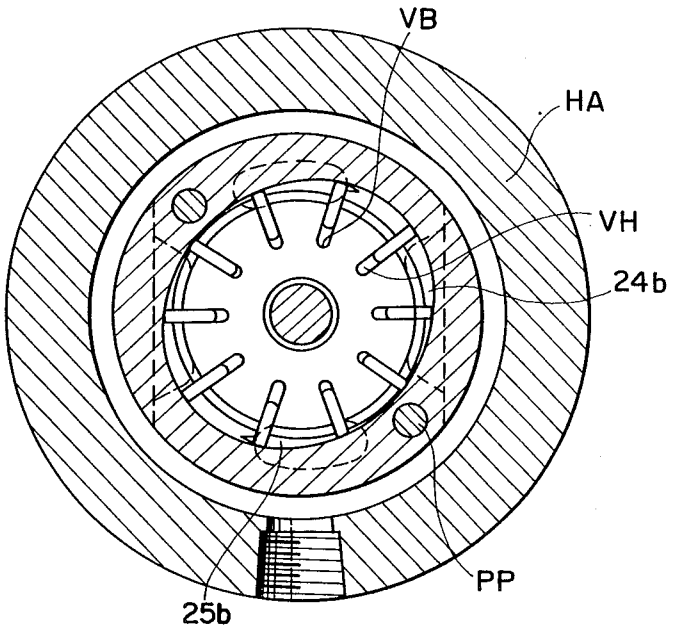
FIGS. 14 through 17 show a hydraulic vane pump according to a second embodiment of the present invention, FIG. 14 being a transverse cross-sectional view of the hydraulic vane pump, FIG. 15 a longitudinal cross-sectional view of the pump, FIG. 16 a set of lift and speed diagrams of a cam curve of the pump, and FIG. 17 a diagram showing the waveforms of an instantaneous flow and a discharge pressure of the pump.

A specific example in which the hydraulic vane pump of the first embodiment is developed so as to belong also to the second and third aspects is shown at "1" in the table 1, with its cam configuration illustrated in FIG. 12.

The table 1 sets forth major values such as cam configuration and various performances obtained with a hydraulic vane pump according to the specific example 1.

Symbols employed in the table 1 and the following description will be defined as follows:

L: lift (cm);

Lmax: maximum lift (cm);

Ks: ratio of maximum value of vane lift changing quantity per unit rotational angle of a 1/180 period of cam configuration, to the maximum value of vane lift, in the expansion section of the inner peripheral surface of the cam ring;

$\theta s_{95}$: proportion (%) of the region (rotational angle) having a lift increasing amount per unit rotational angle of not less than 95% of the maximum value of vane lift changing quantity per unit rotational angle ($\Delta\theta$) in the expansion section of the inner peripheral surface of the cam ring, with respect to rotational angle of one period of the cam configuration;

$\theta S_{05}$: proportion (%) of the region (rotational angle) having a lift increasing amount per unit rotational angle not less than 5% of the maximum value of vane lift changing quantity per unit rotational angle ($\Delta\theta$) in the expansion section of the inner peripheral surface of the cam ring, with respect to rotational angle of one period of the cam configuration;

$\theta S_{50}$: proportion (%) of the region (rotational angle) having a lift increasing amount per unit rotational angle of not less than 50% of the maximum value of vane lift changing quantity per unit rotational angle ($\Delta\theta$) in the expansion section of the inner peripheral surface of the cam ring, with respect to rotational angle of one period of the cam configuration;

Kb: proportion (%/rad) per radian of the average lift reduction of the vane in the large-arc section with respect to the maximum lift;

Rc: base radius (mm) of the inner peripheral surface of the cam ring;

$Q_D$: instantaneous flow (cm$^3$/S);

$\overline{Q}_D$: average of the instantaneous flow (cm$^3$/S);

$q_D$: dimensionless pulsations of the instantaneous flow $$\left(= \frac{Q_D - Q_D}{Q_D}\right);$$

$P_D$: discharge pressure (kgf/cm$^2$);

$\overline{P}_D$: average discharge pressure in the discharge line (kgf/cm$^2$);

N: number of revolutions per one minute of the rotor (r.p.m.);

Ko: bulk modulus of the fluid to be sucked (kgf/cm$^2$);

$\epsilon$: flow pulsation percentage (%) obtained by dividing the amplitude (Peak-to-Peak) of pulsations of the instantaneous flow by the average discharged amount of flow; and $\Delta$Pd: amplitude (Peak-to-Peak) of pulsations of the discharge pressure (kgf/cm$^2$).

Figure 13:
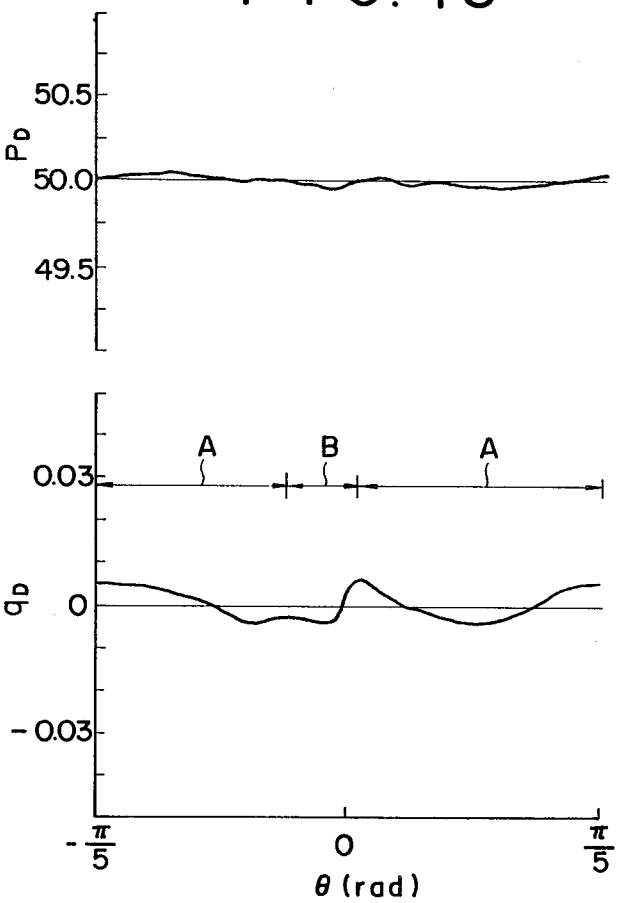

FIG. 13 shows the waveforms of the instantaneous flow and pressure pulsations discharged from the hydraulic vane pump according to the specific example 1. As is evident from the table 1 and FIG. 13, the hydraulic vane pump of the example 1 has an optimized distribution of vane lifting speed by producing a prescribed lift reduction in the maximum lift holding section and limiting the range of $\theta_{s05}$. Therefore, the example 1 is advantagenous in that the allowable range in which the fluid to be sucked is compressible is widened for reducing pulsations under wider operating conditions. The axis of abscissa of FIG. 13 covers a $2\pi/5$ radian of the rotational angle of the rotor, or one vane pitch.

TABLE 1

| | Example | | | | | | |
|---|---|---|---|---|---|---|---|
| | 1 | 2 | 3 | 4 | 5 | 6 | 7 |
| Number of vanes | 5 | 10 | 8 | 10 | 4 | 10 | 8 |
| Type | Unbalanced | Balanced | Balanced | Balanced | Unbalanced | Balanced | Balanced |
| Cam configuration | | | | | | | |
| Ks | 0.0296 | 0.0293 | 0.0249 | 0.0252 | 0.0240 | 0.0280 | 0.0244 |
| $\theta s95$ (%) | 6.93 | 7.11 | 10.83 | 12.21 | 14.18 | 7.5 | 11.4 |
| $\theta s50$ (%) | 18.5 | 19.05 | — | 22.05 | — | 19.83 | — |
| $\theta s05$ (%) | 29.61 | 30.75 | 31.1 | 31.95 | 31.2 | 31.23 | 31.2 |
| Kb (%/rad) | 2.80 | 2.67 | 4.46 | 3.85 | 0.0 | 4.46 | 3.08 |
| Conditions | | | | | | | |
| N (r.p.m.) | 750 | 1000 | 1000 | 1000 | 1000 | 1000 | 1000 |
| PD (kgf/cm$^2$) | 50 | 50 | 50 | 50 | 50 | 50 | 50 |
| Ko (kgf/cm$^2$) | 12000 | 12000 | 90 | 50 | 1300 | 90 | 150 |
| Results | | | | | | | |
| $\epsilon$ (%) | 1.1 | 0.7 | 10.7 | 7.0 | 2.8 | 5.8 | 3.4 |

TABLE 1-continued

| | Example | | | | | | |
|---|---|---|---|---|---|---|---|
| | 1 | 2 | 3 | 4 | 5 | 6 | 7 |
| Number of vanes | 5 | 10 | 8 | 10 | 4 | 10 | 8 |
| ΔPD(kgf/cm$^2$) | 0.1 | 0.08 | 0.55 | 0.5 | 0.2 | 0.28 | 0.25 |

A hydraulic vane pump according to a second embodiment which belongs to the second aspect of the present invention will be described with reference to FIGS. 14 through 17.

According to the second embodiment, the present invention is applied to a balanced-force-type hydraulic vane pump for industrial use including a cam ring having an inner peripheral surface shaped such that the ratio of maximum value of vane lift changing quantity per unit rotational angle of a 1/180 period of cam configuration, to the maximum value of vane lift, in the expansion section is 0.029, that is, the ratio of a maximum vane lift increase per one degree of rotational angle of the rotor to the maximum vane lift is 0.029, and the region (rotational angle) having a lift increasing amount per unit rotational angle of not less than 5% of the maximum value of vane lift changing quantity per unit rotational angle ($\theta\Delta$) in the expansion section of the inner peripheral surface of the cam ring has a ratio ($\theta S_{05}$) of 30.75% of rotational angle ($\theta x$) of one period of the cam configuration.

The construction, operation and advantages of the hydraulic vane pump according to the first embodiment will be described in detail with particular reference to the differences with the first embodiment.

The hydraulic vane pump according to the second embodiment has a housing HA comprising a hollow cylindrical member having a larger-diameter portion HA1 and a smaller-diameter portion HA2. The smaller-diameter portion HA2 of the housing HA has a plan bearing BR and a drive shaft DS. The drive shaft DS is rotatably supported by the plain bearing BR mounted in the housing HA. The larger-diameter portion HA1 of the housing HA houses therein a rotor RT, vanes VA, a cam ring CR, side plates SP1, SP2, pins PP, a spring SR, and an outer cover OC.

The rotor RT is sandwiched between the side plates SP1, SP2 and splined to the drive shaft DS for being driven thereby. The rotor RT is disposed coaxially on the drive shaft DS for rotation therewith. The cam ring CR is disposed around the rotor RT as a guide ring for limiting reciprocating movement of the vanes VA. The cam ring CR and the side plates SP1, SP2 are assembled and fixed in the housing HA by the two common pins PP against rotation with respect to the housing HA.

The rotor RT has vane slots VH in which ten vanes VA are radially disposed, respectively. These vanes VA can be lifted into contact with an inner peripheral surface 22 of the cam ring CR under suitable centrifugal forces acting on the vanes VA and suitable hydraulic forces acting on vane bottom VS due to a discharged fluid led through communication holes 26, 28 and arcuate glooves 27, 29 defined in the side plate SP1 and fluid reservoir slots VB defined in the rotor. The vanes have tip ends 21 rotatable with the rotor RT along the inner peripheral surface 22 of the cam ring.

The inner peripheral surface 22 of the cam ring is shaped such that the distance between the inner peripheral surface 22 and the rotor RT will vary as the latter rotates. With such a surface configuration, the volume of a space or vane chamber defined jointly by the rotor RT, each pair of adjacent vanes, the cam ring CR, and the side plates SP1, SP2 is alternately expanded and compressed in two cycles during one revolution of the drive shaft DS. The side plates SP1, SP2, have inlet ports *24a*, *24b* positioned for communication with the vane chamber in the expansion stroke, and outlet ports *25a*, *25b* positioned for communication with the vane chamber in the compression stroke. The vane chamber opens into the inlet ports to suck a fluid therefrom in the expansion stroke, and opens into the outlet ports to discharge the fluid thereinto in the compression stroke.

The side plate SP1 is pressed against a side surface of the cam ring CR at all times by the spring SP interposed between the outer cover OC and the side plate SP1. A discharge pressure acts on a side surface of the side plate SP1 to keep the vane chambers airtight.

The housing HA has a suction hole FI and a discharge hole FO communicating with the inlet ports *24a*, *24b* and the outlet ports *25a*, *25b*, respectively.

The inner peripheral surface of the cam ring CR has a cam curve formed thereon and having a configuration expressed by a plurality of equations of higher degrees in the expansion section in the inlet region, in which particularly the lift of the vanes VA is increased, of the cam configuration of the inner peripheral surface of the cam ring as shown in FIG. 4, so that an instantaneous flow produced when the fluid is discharged will have a waveform as shown in FIG. 5.

More specifically, the cam curve formed on the inner peripheral surface of the cam ring of the hydraulic vane pump according to the second embodiment has a configuration such that the ratio of the maximum value of vane lift changing quantity per unit rotational angle of a 1/180 period of cam configuration, to the maximum value of vane lift, in the expansion section of the inner peripheral surface of the cam ring is 0.029, and the region having a lift increasing amount per unit rotational angle of not less than 5% of the maximum value of vane lift changing quantity per unit rotational angle ($\theta 66$ ) in the expansion section of the inner peripheral surface of the cam ring has a ratio of 30.75% of a rotational angle ($\theta x$) of one period of the cam configuration.

With this arrangement, the lifting movement of the vane toward the inner peripheral surface of the cam ring is rendered slow so that the speed at which the vane is lifted against the inner peripheral surface of the cam ring to follow the same can be lowered without increasing the vane lifting acceleration.

The hydraulic vane pump of the second embodiment being thus constructed, the lifting movement of the vane toward the innner peripheral suface of the cam ring is slow, and flow and pressure pulsations of the fluid discharged from the hydraulic vane pump can greatly be reduced, with the consequence that noises and vibrations will be prevented from being generated in the hydraulic system.

By lowering the speed at which the vanes slide in the vane slots in the rotor, the sliding resistance therebetween can be reduced to improve the ability of the vanes to follow the inner peripheral surface of the cam ring.

Where the fluid to be sucked into the vane pump has a bulk modulus (K) which is relatively high in the range of 1,200 to 16,000 kgf/cm$^2$, the hydraulic vane pump of the second embodiment has better advantages.

Figure 16:
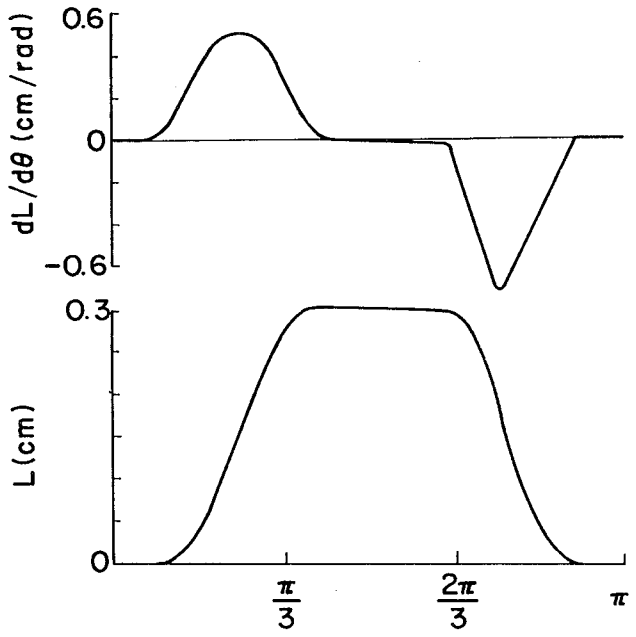
Figure 15:
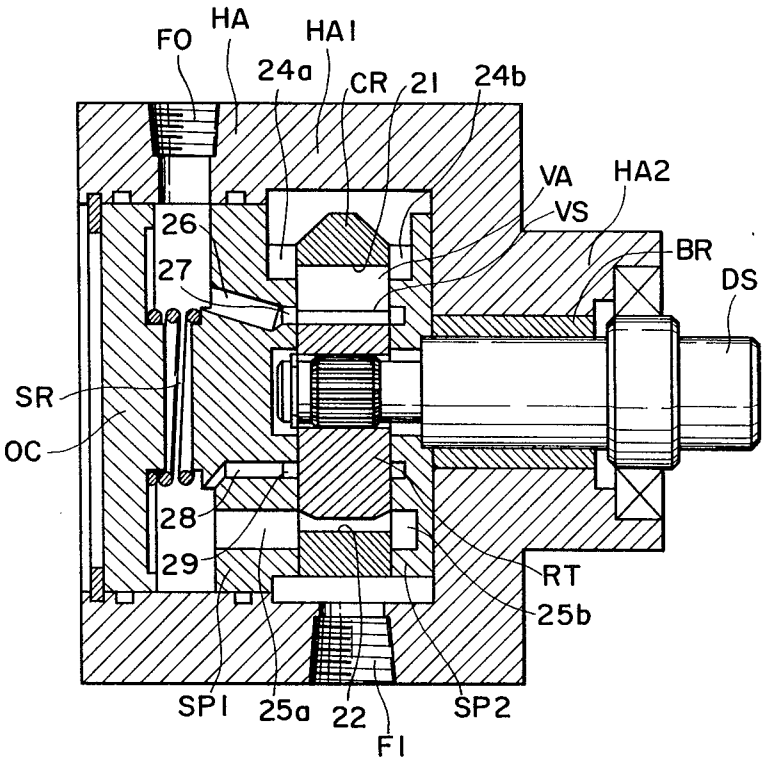
Figure 18:
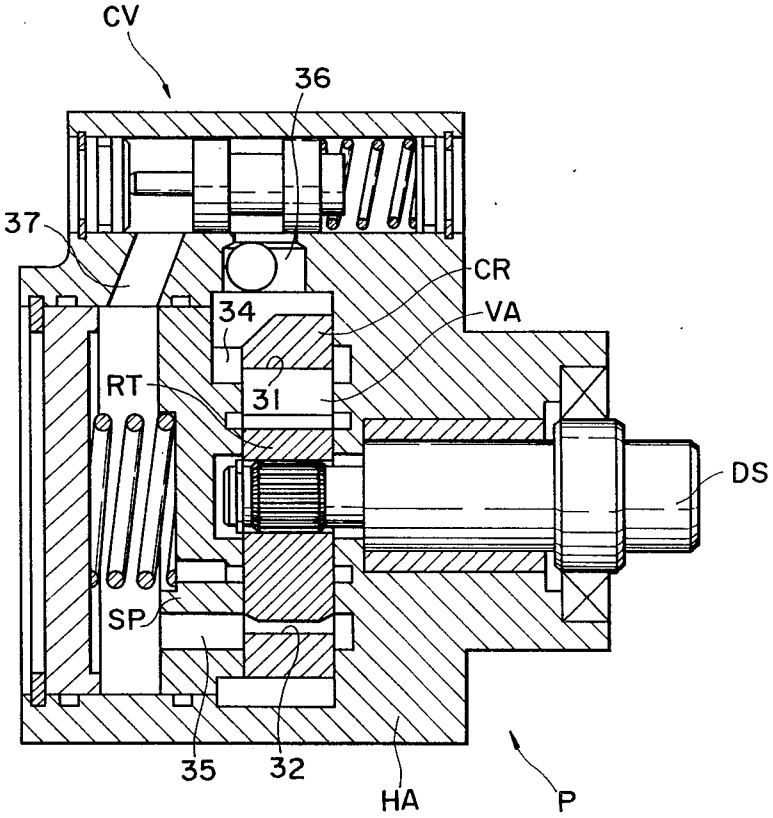
FIGS. 18 through 21 show a hydraulic vane pump according to a third embodiment of the present invention, FIG. 18 being a longitudinal cross-sectional view of the hydraulic vane pump, FIG. 19 a schematic view illustrating the pump in transverse cross section and a hydraulic circuit incorporating the pump, FIG. 20 a set of lift, speed and acceleration diagrams of a cam of the pump, and FIG. 21 a diagram showing the waveforms of an instantaneous flow and a discharge pressure of the pump.

A specific example in which the hydraulic vane pump of the second embodiment is developed so as to belong also to the first and third aspects is shown at "2" in the table 1, with its cam configuration illustrated in FIG. 16.

Figure 17:
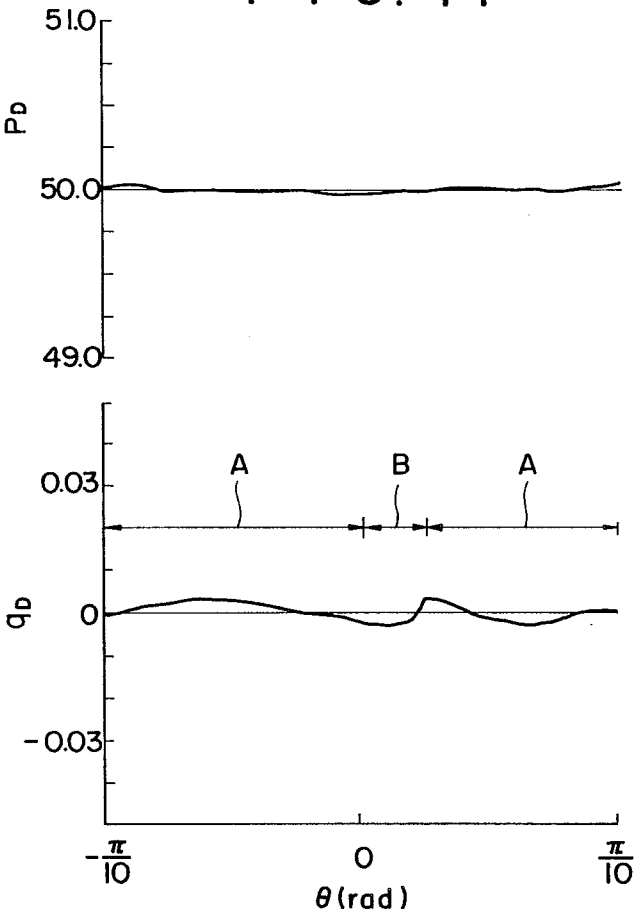

The table 1 sets forth major values such as cam configuration and various performances obtained with a hydraulic vane pump according to the specific example 2. FIG. 17 shows the waveforms of the instantaneous flow and pressure pulsations discharged from the hydraulic vane pump according to the specific example 2. As is evident from table 1 and FIG. 17, the hydraulic vane pump of the example 1 is advantageous in that it optimizes the lifting speed of the vane in the vicinity of the maximum vane lift changing quantity per unit rotational angle in the expansion section, and a prescribed lift reduction is provided in the expansion section to more reduce variations in the regions A, B. The axis of abscissa of FIG. 17 covers a $\pi/5$ radian of the rotational angle of the rotor, or one vane pitch.

A hydraulic vane pump according to a third embodiment which belongs to the third aspect of the present invention will be described with reference to FIGS. 18 through 21.

According to the third embodiment, the present invention is applied to a balanced-force-type hydraulic vane pump for an automotive power steering system which is driven as by an engine having varying numbers of RPM, the vane pump having eight vanes which are a minimum number in this type of hydraulic vane pump. A cam ring has an inner peripheral surface shaped such that the ratio of maximum value of vane lift changing quantity per unit rotational angle of a 1/180 period of cam configuration, to the maximum value of vane lift, in the expansion section is 0.025, that is, the ratio of a maximum vane lift increase per degree of rotational angle of the rotor to the maximum vane lift is 0.025, and the percentage (Kb), per radian in the direction of rotation, of the average lift reduction for the vane in the maximum lift holding section with respect to a maximum lift is 4.5%.

The construction, operation and advantages of the hydraulic vane pump according to the third embodiment will be described in detail with particular reference to the differences with the second embodiment and to the features of the inner peripheral surface of the cam ring.

The power steering system for incorporating the hydraulic vane pump of the third embodiment includes a hydraulic vane pump P, a power steering gear box EC and a fluid tank FT which are connected to the hydraulic vane pump P by conduits.

The hydraulic vane pump P is driven by an engine, and the amount of a fluid discharged from the hydraulic vane pump P per unit time varies in proportion to the number of RPM of the engine. The hydraulic vane pump P has an inlet port 34, an outlet port 35, a cam ring CR, vanes VA, a rotor RT, and a side plate SP. The volume of a space or vane chamber defined jointly by the rotor RT, each pair of adjacent vanes VA, the cam ring CR, and the side plate SP is alternately expanded and compressed in two cycles during one revolution of the drive shaft DS for sucking a fluid from the inlet port 34 and discharging the fluid under compression into the outlet port 35.

The rotor RT has vane slots VH in which eight vanes VA are radially disposed, respectively. These vanes VA can be lifted into contact with an inner peripheral surface 32 of the cam ring CR under centrifugal forces acting on the vanes VA and hydraulic forces acting on vane bottoms VS due to a discharged fluid led into fluid reservoir slots VB. The vanes have tip ends 31 rotatable with the rotor RT along the inner peripheral surface 32 of the cam ring.

The fluid discharged under pressure from the hydraulic vane pump P is delivered through a discharge path 37 to a flow control valve CV. A constant amount of fluid flow or an amount of fluid flow in a prescribed pattern which is controlled by the flow control valve CV is then supplied to the power steering gear box EC. Any amount of fluid in excess of the required fluid amount supplied from the hydraulic vane pump P to the power steering gear box EC flow back to a return path 36 leading to the inlet port 34. The fluid the energy of which is consumed by the power steering gear box EC is all led to and stored in the fluid tank FT. The fluid is then sucked from the fluid tank FT to the hydraulic vane pump P.

The inner peripheral surface of the cam ring CR has a cam curve formed thereon and having a configuration expressed by a plurality of equations of higher degrees in the expansion section in the suction region, in which particularly the lift of the vanes VA is increased, of the cam configuration of the inner peripheral surface of the cam ring as shown in FIG. 4, so that an instantaneous flow produced when the fluid is discharged will have a waveform as shown in FIG. 6.

More specifically, the cam curve formed on the inner peripheral surface of the cam ring of the hydraulic vane pump according to the third embodiment has a configuration such that the ratio of maximum value of vane lift changing quantity per unit rotational angle of a 1/180 period of cam configuration, to the maximum value of vane lift, in the expansion section of the inner peripheral surface of the cam ring is 0.025, and the percentage, per radian in the direction of rotation, of the lift reduction for the vane in the large-arc section with respect to a maximum lift is 4.5%.

With the hydraulic vane pump to the third embodiment thus constructed, even where the fluid has unstable compressibility due to inclusion of air bubble and the discharge pressure is variable, flow and pressure pulsations of the fluid discharged from the hydraulic vane pump can be reduced for thereby preventing the hydraulic system from generating noises and vibrations.

Since the prevention of noises and vibrations is achieved by reducing the number of vanes used to the extent that has not been conventionally possible, the hydraulic vane pump can be manufactured less costly, is more lightweight, and smaller in size, and hence finds in a wider applications of use.

Where the fluid to be sucked into the vane pump has a bulk modulus ($K_0$) in the range of 70 to 500 kgf/cm$^2$, the hydraulic vane pump of the third embodiment has better advantages.

Figure 20:
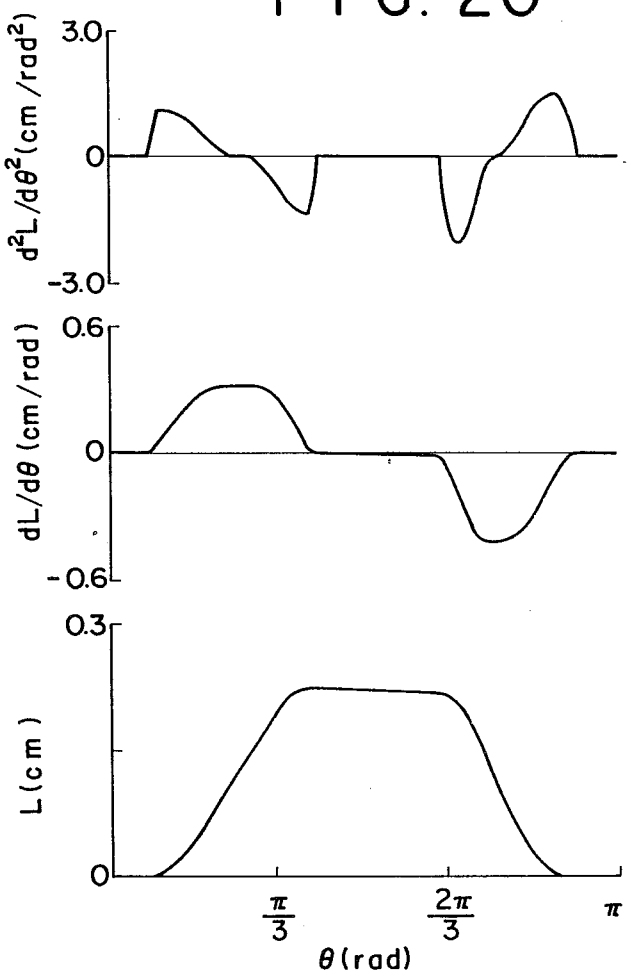
Figure 19:
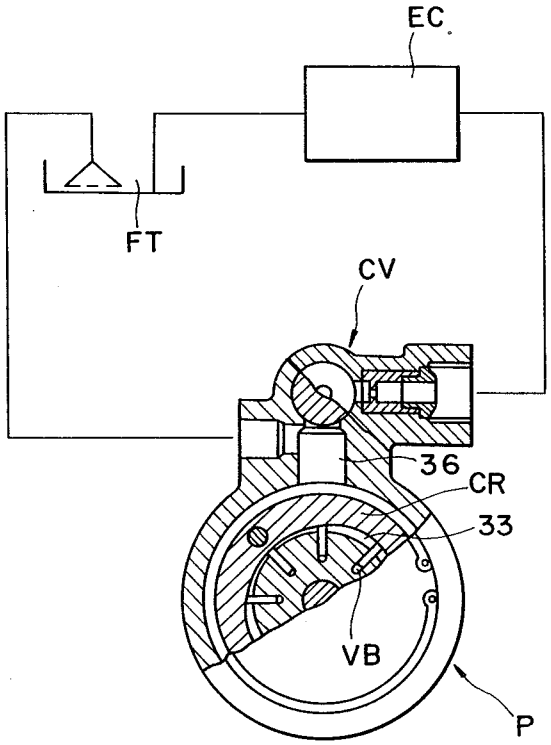

A specific example in which the hydraulic vane pump of the third embodiment is developed so as to belong also to the first and second aspects is shown at "3" in the table 1, with its cam configuration illustrated in FIG. 20.

Figure 21:
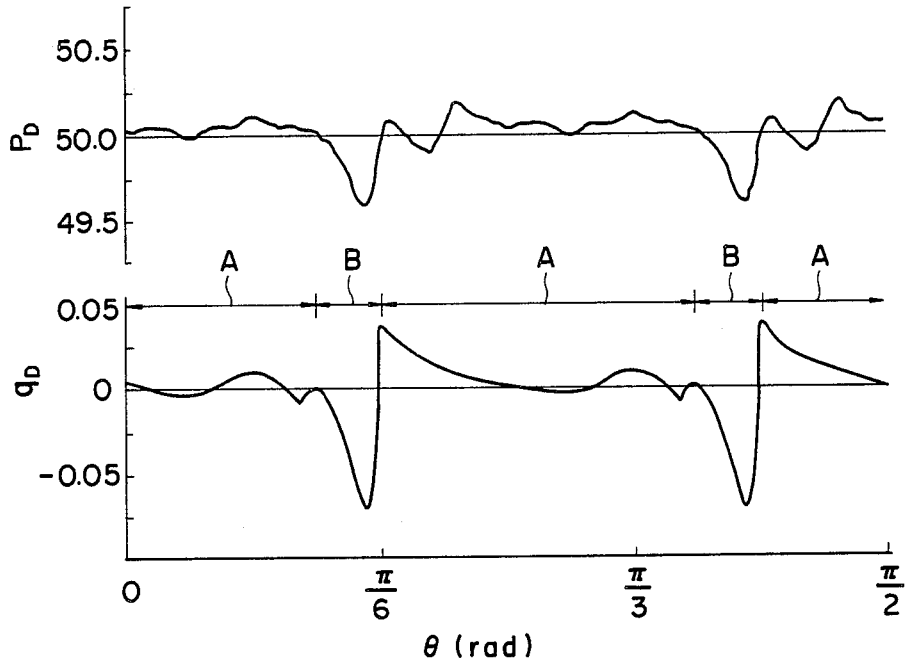
Figure 23:
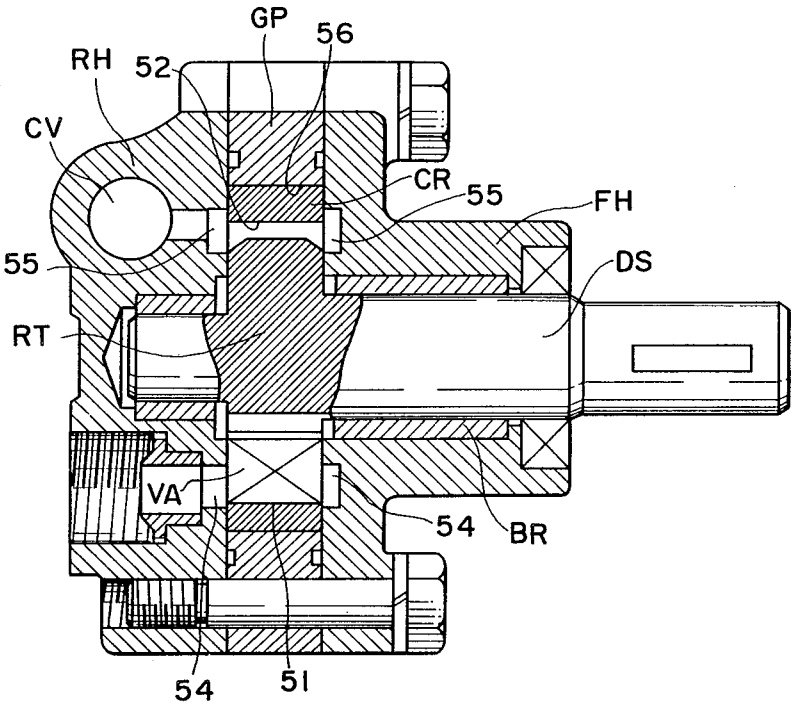
FIGS. 23 through 26 illustrate a hydraulic vane pump according to a fifth embodiment of the present invention, FIG. 23 being a longitudinal cross-sectional view of the hydraulic vane pump, FIG. 24 a schematic view illustrating the pump in transverse cross section and a hydraulic circuit incorporating the pump, FIG. 25 a set of lift and speed diagrams of a cam curve of the pump, and FIG. 26 a diagram showing the waveforms of an instantaneous flow and a discharge pressure of the pump.

The table 1 sets forth major values such as cam configuration and various performances, along with conditions, obtained with a hydraulic vane pump according to the specific example 3. FIG. 21 shows the waveforms of the instantaneous flow and pressure pulsations discharged from the hydraulic vane pump according to the specific example 3.

As is evident from the table 1 and FIG. 21, the hydraulic vane pump of the example 3 is advantageous in that it has an optimized distribution of lifting speeds of the vane, and the amount of discharged fluid supplied to the vane bottoms is given a prescribed pattern of irregularity. The hydraulic vane pump can be used with fluids having a wide range of compressibilities even in the case where the fluid compressibility is not determined by operating conditions.

The axis of abscissa of FIG. 21 covers a $\pi/2$ radian of the rotational angle of the rotor, or two vane pitches.

A hydraulic vane pump according to a fourth embodiment which belongs to the fourth aspect of the present invention will be described with reference to FIG. 22.

According to the fourth embodiment, the present invention is applied to a balanced-force-type hydraulic vane pump for use on an automobile, which includes a cam ring having an inner peripheral surface shaped such that the ratio of maximum value of vane lift changing quantity per unit rotational angle of a 1/180 period of cam configuration, to the maximum value of vane lift, in the expansion section is 0.025, that is, the ratio of a maximum vane lift increase per degree of rotational angle of the rotor to the maximum vane lift is 0.025.

The construction, operation and advantages of the hydraulic vane pump according to the fourth embodiment will be described in detail with particular reference to the differences with the third embodiment.

Like the above-described third embodiment, the hydraulic vane pump according to the fourth embodiment is used as a balanced-force-type hydraulic vane pump for use on an automobile under such conditions that the fluid sucked into the pump have a low bulk modulus and contains a large quantity of air bubbles. The number of vanes used is ten. The inner peripheral surface of a cam ring has a cam curve formed thereon and having a configuration expressed by a plurality of equations of higher degree in the expansion section in the suction region, in which particularly the lift of the vanes is increased, of the cam configuration of the inner peripheral surface of the cam ring as shown in FIG. 4, so that an instantaneous flow produced when the fluid is discharged will have a waveform as shown in FIG. 6.

More specifically, the ratio of maximum value of vane lift changing quantity per unit rotational angle of a 1/180 period of cam configuration, to the maximum value of vane lift, in the expansion section of the inner peripheral surface of the cam ring is 0.025.

With the hydraulic pump of the fourth embodiment thus constructed, the consumption of the discharged fluid supplied to the vane bottoms is more suppressed, and flow and pressure pulsations of the fluid discharged from the hydraulic vane pump can be reduced even in the case where the fluid has a considerably low bulk modulus due for example to a large quantity of air bubbles contained in the fluid. Accordingly, the hydraulic system in which the hydraulic vane pump is incorporated is prevented from producing noises and vibrations.

Where the fluid to be sucked into the vane pump has a bulk modulus (K) in the range of 40 to 300 kgf/cm$^2$, the hydraulic vane pump of the fourth embodiment has better advantages.

Figure 22:
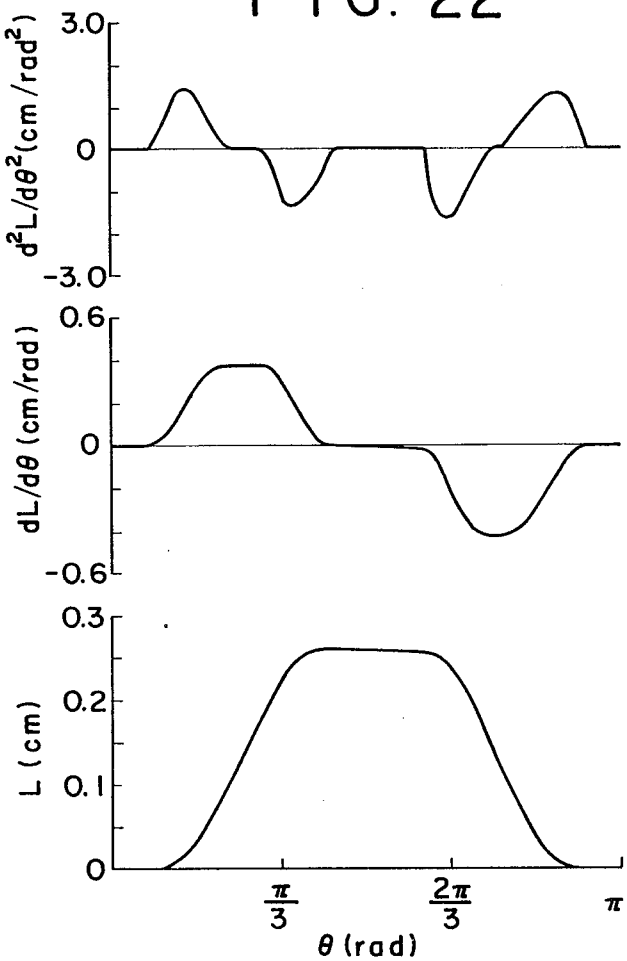
FIG. 22 is a set of lift, speed and acceleration diagrams of a cam curve of a hydrualic vane pump according to a fourth embodiment of the present invention.
Figure 24:
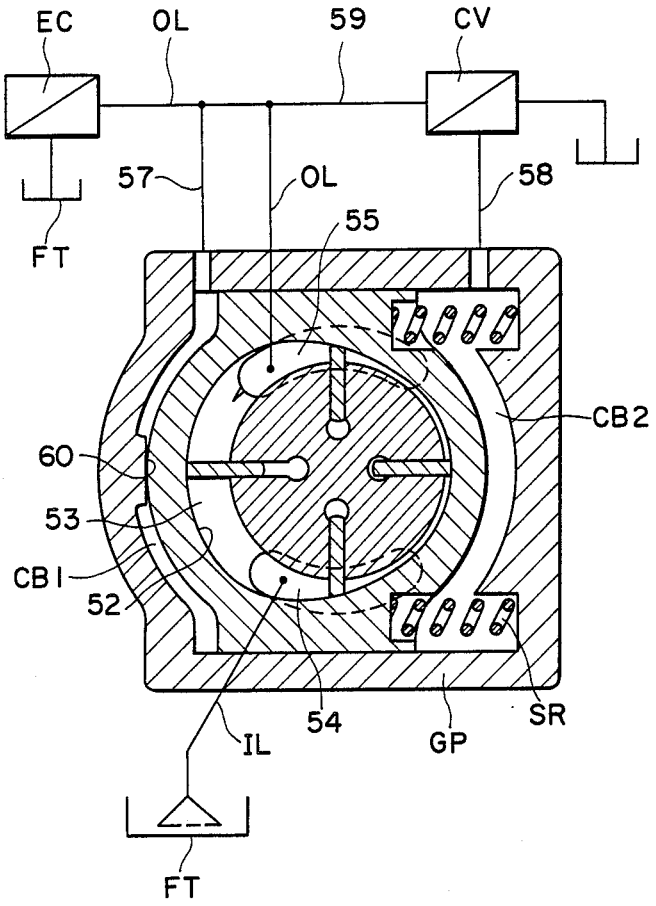

A specific example in which the hydraulic vane pump of the fourth embodiment is developed so as to belong also to the first, second and third aspects is shown at "4" in the table 1, with its cam configuration illustrated in FIG. 22.

The table 1 sets forth major values such as cam configuration and various performances, along with conditions, obtained with a hydraulic vane pump according to the specific example 4.

As is evident from the table 1, the hydraulic vane pump of the example 4 is advantageous in that the vane lifting speed distribution is selected to more uniformize the flow of the discharged fluid supplied to the vane bottoms in order to reduce the instantaneous flow, and the vane lift in the large-arc section is reduced to precompress the confining vane chamber to reduce or eliminate a large drop of the instantaneous flow waveform in the region B for reducing pulsations mainly of a fluid having a low bulk modulus.

A hydraulic vane pump according to a fifth embodiment belonging to the fifth aspect of the invention will hereinafter be described with reference to FIGS. 23 through 26.

According to the fifth embodiment, the present invention is applied to an unbalanced-force-type variable-displacement hydraulic vane pump for use on an automobile. The hydraulic vane pump includes a cam ring having an inner peripheral surface shaped such that the ratio of the maximum value of vane lift changing quantity per unit rotational angle of a 1/180 period of cam configuration, to the maximum value of vane lift, in the expansion section of the inner peripheral surface of the cam ring is 0.024 in a most eccentric condition, that is, the ratio of a maximum vane lift increase per one degree of the rotational angle of the rotor to the maximum vane lift is 0.012.

The construction, operation and advantages of the hydraulic vane pump according to the fifth embodiment will be described in detail with particular reference to the cam configuration on the inner peripheral surface of the cam ring.

The hydraulic vane pump P according to the fifth embodiment has a housing HA in the form of a hollow cylindrical member composed of a rear housing RH, a front housing FH, and a guide plate GP. The front housing FH has a plain bearing BR mounted therein and rotatably supporting a drive shaft DS. The guide plate GP has upper and lower parallel inner guide surfaces defining a hollow space therebetween housing therein a rotor RT, vanes VA, and a cam ring CR. The cam ring CR is slidable against a guide surface 56 of the guide plate GP into a position for producing a desired amount of discharged fluid.

The rotor RT is disposed centrally in the cam ring CR and integral with the drive shaft DS which is rotatably supported in the housing. The vanes VA, which are four in number, are radially mounted at equal intervals in an outer periphey of the rotor RT. A discharged fluid is led under pressure to the bottoms of the vanes VA for causing tip ends 51 of the vanes VA to be held slidably against an inner peripheral surface 52 of the cam ring CR at all times for rotation with the rotor RT.

The front and rear housings FH, RH are spaced axially of the hydraulic vane pump P in sandwiching relation to the guide plate GP, the cam ring CR, the rotor RT, and the vanes VA. The axial width of the cam ring CR, the rotor RT, and the vanes VA is slightly smaller than the axial dimension of the guide plate GP for allowing oil films to be formed on sliding side surfaces of these components. The front housing FH has an inlet port 54 communicating with a fluid tank FT, and the rear housing RH has an outlet port 55 communicating with a discharge line OL connected to a hydraulic-pressure-to-power converter EC.

Two adjacent vanes VA, an outer peripheral surface of the rotor Rt, the inner peripheral surface 52 of the cam ring CR, the side surface of the front housing FH, and the side surface of the rear housing RH jointly define vane chambers 53 each having a volume which is alternately increased (expanded) and reduced (compressed) in one cycle during one revolution of the rotor RT.

The amount of fluid discharged from the hydraulic vane pump P while the rotor RT makes one revolution is determined on the basis of the difference between the maximum and minimum volumes of the vane chamber. The smaller the eccentricity of the cam ring CR with respect to the rotor RT, or the greater the distance the cam ring CR is displaced to the right as shown, the smaller the difference between the maximum and minimum volumes of the vane chamber.

In the region in which the fluid volume in the vane chamber 53 increases, the vane chamber 53 communiates with the inlet port 54 to suck the fluid into the vane chamber 53, and in the region in which the fluid volume in the vane chamber 53 decreases, the vane chamber 53 communicates with the outlet port 55 to discharge the fluid from the vane chamber 53 into the outlet port 55. The fluid discharged from the hydraulic pump P through the outlet port 55 is supplied through the discharge line OL to the fluid-pressure-to-power converter EC which converts all energy of the fluid into mechanical power that will be consumed. Thereafer, the fluid is returned through a conduit to the fluid tank FT and then sucked through a suction line IL again into the hydraulic vane pump P.

The housing HA has a chamber defined between an inner peripheral surface of the guide plate GP and an outer peripheral surface of the cam ring CR and including a first chamber CB1 positioned in the direction in which the spring force of a spring SP acts. The discharged fluid is led into the first chamber CB1 through a branch line 57 from the discharge line OL. The chamber in the housing also includes a second chamber CB2 disposed oppositely to the first chamber CB1. The spring SR is placed in the second chamber CB2 for normally urging the cam ring CR into contact with a stopper 60 in a most eccentric position with respect to the rotor RT.

A control valve CV is integral with the housing HA for changing the fluid pressure in the second chamber CB2 in the range from the discharge pressure to the atmospheric pressure to control the cam ring CR for discharging the fluid under a prescribed pressure through a branch line 59 extending from the discharge line OL.

The configuration of a cam curve formed on the inner peripheral surface 52 of the cam ring CR as it is in the most eccentric position, especially the cam configuration in the expansion section as shown in FIG. 4, is composed of a curve expressed in a plurality of equations of higher order, such for example as equations of first, fourth and fifth degree and two equations of sixth degree, so that an instantaneous flow generated when the fluid is discharged will have a time-base waveform as illustrated in FIG. 5.

More specifically, the cam curve on the inner peripheral surface of the cam ring of the hydraulic vane pump of the fifth embodiment is shaped such that the ratio of maximum value of vane lift changing quantity per unit rotational angle of a 1/180 period of cam configuration, to the maximum value of vane lift, in the expansion section is 0.024.

With the hydraulic vane pump of the fifth embodiment thus constructed, the consumption of the discharged fluid supplied to the vane bottoms is more suppressed, and flow and pressure pulsations of the fluid discharged from the hydraulic vane pump can be reduced to prevent the hydraulic system in which the hydraulic vane pump is incorporated from producing noises and vibrations.

According to the fifth embodiment, the cam configuration can be best suited for a hydraulic vane pump having four vanes in one period of the cam configuration. Thus, the hydraulic vane pump can be rendered lightweight and small in size, and may be used as an automatic transmission pump for an automobile, particular a passenger car, or as a power steering pump with the fluid control circuit modified. The hydraulic vane pump produces small pressure pulsations in wider conditions of use than conventionally possible, so that noise and vibration generated in the hydraulic system especially around the pump will be greatly reduced.

Lower flow and pressure ripple levels can be achieved by designing the shapes of the inlet port and the outlet port with a notch in one end so as to be best suited to the cam configuration.

Since the hydraulic vane pump of the fifth embodiment is of the variable-displacement type, it can reduce power consumption as compared with conventional pressure control valves or a fixed-displacement pump with a flow control valve. Accordingly, the hydraulic vane pump can improve fuel economy when the automobile incorporating the hydraulic vane pump runs, and allows comfortable running conditions and maneuverability.

Where the fluid to be drawn into the vane pump has a bulk modulus ($K_0$) in the range of 500 to 16,000 kgf/cm$^2$, the hydraulic vane pump of the fifth embodiment has better advantages.

Figure 25:
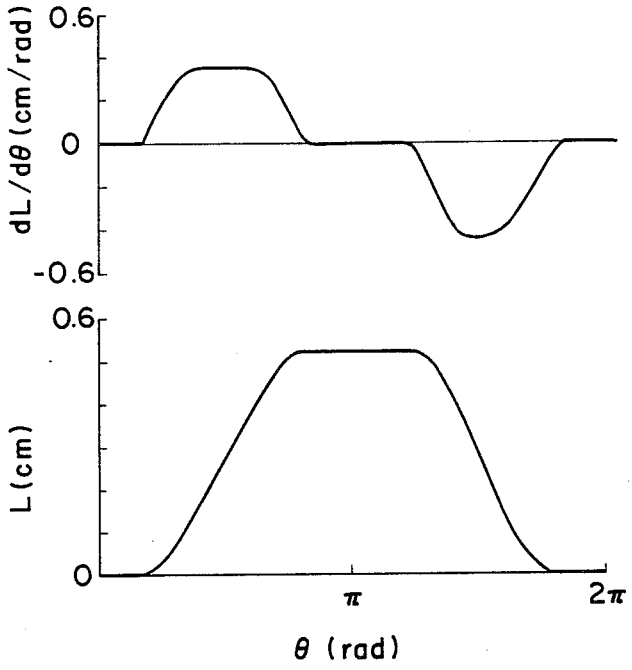

A specific example in which the hydraulic vane pump of the fifth embodiment is developed so as to belong also to the first and second aspects is shown at "5" in the table 1, with its cam configuration illustrated in FIG. 25.

The table 1 sets forth major values such as cam configuration and various performances, along with conditions, obtained with a hydraulic vane pump according to the specific example 5.

Figure 26:
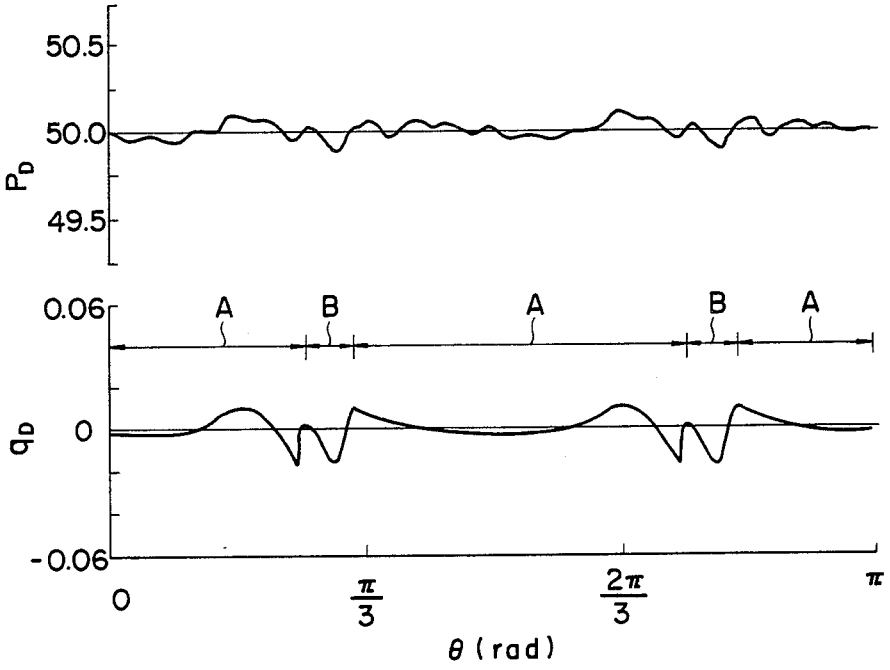

FIG. 26 illustrates the pulsating waveforms of the instantaneous flow and discharge pressure of the hydraulic vane pump according to the specific example 5.

As is apparent from the table 1 and FIG. 26, the example 5 is advantageous in that the region in which the vane lifting speed is high is selected to be as wide as possible to thereby uniformize the amount of the discharged fluid supplied to the vane bottoms to reduce flow and pressure pulsations, and hence prevent an increased acceleration of vane lifting movement which would otherwise be caused by flow and pressure pulsations. The axis of abscissa of FIG. 26 covers a $\pi$ radian of the rotational angle of the rotor, or two vane pitches.

A hydraulic vane pump according to a sixth embodiment belonging to the sixth aspect of the invention will hereinafter be described with reference to FIGS. 27 and 28.

According to the sixth embodiment, the present invention is applied to a balanced-force-type hydraulic vane pump for use on an automobile. The hydraulic vane pump includes a cam ring having an inner peripheral surface shaped such that the ratio of maximum value of vane lift changing quantity per unit rotational angle of a 1/180 period of cam configuration, to the maximum value of vane lift, in the expansion section is 0.028, that is, the ratio of a maximum vane lift increase per one degree of the rotational angle of the rotor to the maximum vane lift is 0.028. The region (rotational angle) having a lift increasing amount per unit rotational angle of not less than 95% of the maximum value of vane lift changing quantity per unit rotational angle ($\theta\Delta$) in the expansion section of the inner peripheral surface of the cam ring is 7.5% of a rotational angle ($\theta x$) of one period of the cam configuration, and the region (rotational angle) having a lift increasing amount per unit rotational angle of not less than 50% of the maximum value of vane lift changing quantity per unit rotational angle ($\theta\Delta$) in the expansion section of the inner peripheral surface of the cam ring is 19.8% of a rotational angle ($\theta x$) of one period of the cam configuration.

The construction, operation and advantages of the hydraulic vane pump according to the sixth embodiment now be described in detail with particular reference to the differences with the third embodiment.

Like the above-described third embodiment, the hydraulic vane pump according to the sixth embodiment is used as a balanced-force-type hydraulic vane pump for use on an automobile under such conditions that the fluid sucked into the pump have a low bulk modulus. The number of vanes used is ten. The inner peripheral surface of a cam ring has a cam curve formed thereon and having a configuration expressed by a plurality of equations of higher degree in the expansion section in the suction region, in which particularly the lift of the vanes is increased, of the cam configuration of the inner peripheral surface of the cam ring as shown in FIG. 4, so that an instantaneous flow produced when the fluid is discharged will have a waveform as shown in FIG. 6.

More specifically, the cam curve formed on the inner peripheral surface of the cam ring of the hydraulic vane pump according to the sixth embodiment is shaped such that the ratio of maximum value of vane lift changing quantity per unit rotational angle of a 1/180 period of cam configuration, to the maximum value of vane lift, in the expansion section of the inner peripheral surface of the cam ring is 0.028, the region (rotational angle) having a lift increasing amount per unit rotational angle of not less than 95% of the maximum value of vane lift changing quantity per unit rotational angle ($\theta\Delta$) in the expansion section of the inner peripheral surface of the cam ring is 7.5% of a rotational angle ($\theta x$) of one period of the cam configuration, and the region (rotational angle) having a lift increasing amount per unit rotational angle of not less than 50% of the maximum value of vane lift changing quantity per unit rotational angle ($\theta\Delta$) in the expansion section of the inner peripheral surface of the cam ring is 19.8% of a rotational angle ($\theta x$) of one period of the cam configuration.

With the hydraulic vane pump of the sixth embodiment of the foregoing arrangement, even where the fluid has a relatively low bulk modulus due for example to inclusion of air bubbles, flow and pressure pulsations of the fluid discharged from the hydraulic vane pump can be reduced for thereby preventing the hydraulic system from generating noises and vibrations.

Where the fluid to be sucked into the vane pump has a bulk modulus (Ko) in the range of 70 to 1,500 kgf/cm$^2$, the hydraulic vane pump of the sixth embodiment has better advantages.

Figure 27:
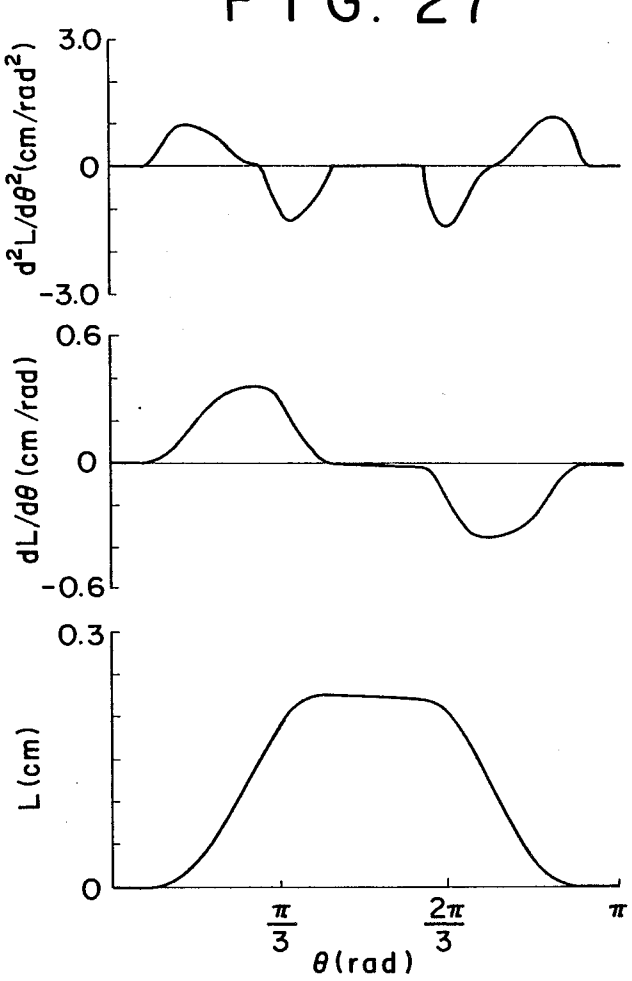
FIGS. 27 and 28 are explanatory of a hydraulic vane pump according to a sixth embodiment of the present invention, FIG. 27 being a set of lift, speed and acceleration diagrams of a cam curve of the pump, and FIG. 28 a diagram showing the waveforms of an instantaneous flow and a discharge pressure of the pump.

A specific example in which the hydraulic vane pump of the sixth embodiment is developed so as to belong also to the second and third aspects is shown at "6" in the table 1, with its cam configuration illustrated in FIG. 27. The table 1 sets forth major values such as cam configuration and various performances, along with conditions, obtained with a hydraulic vane pump according to the specific example 6.

Figure 28:
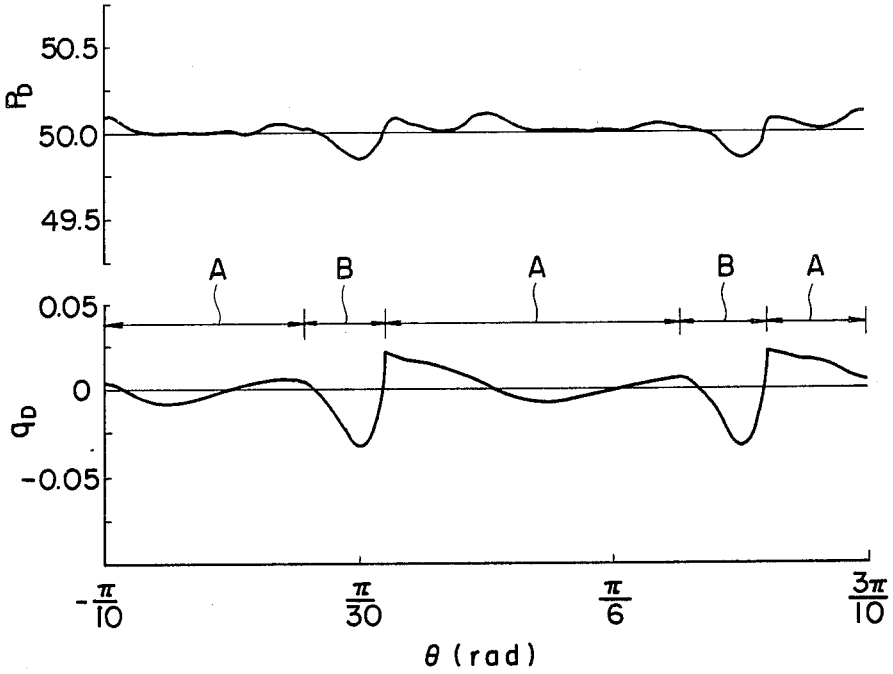

FIG. 28 illustrates the pulsating waveforms of the instantaneous flow and discharge pressure of the hydraulic vane pump according to the specific example 6.

As is apparent from the table 1 and FIG. 28, the example 6 is advantageous in that the vane lifting acceleration is lowered, the vane lifting speed is reduced as a whole, and the vane lift in the maximum lift holding section is reduced to pre-compress the confining vane chamber to reduce or eliminate a large drop of the instantaneous flow waveform in the region B for reducing noise and vibration mainly of a fluid having a low bulk modulus.

A hydraulic vane pump according to a seventh embodiment belonging to the seventh aspect of the invention will hereinafter be described with reference to FIGS. 29 and 30.

According to the seventh embodiment, the present invention is applied to a balanced-force-type hydraulic vane pump for industrial use. The hydraulic vane pump includes a cam ring having an inner peripheral surface shaped such that the ratio of maximum value of vane lift changing quantity per unit rotational angle of a 1/180 period of cam configuration, to the maximum value of vane lift, in the expansion section of the inner peripheral surface of the cam ring is 0.024, that is, the ratio of maximum vane lift increase per degree of the rotational angle of the rotor to the maximum vane lift is 0.0244. The region (rotational angle) having a lift increasing amount per unit rotational angle of not less than 95% of maximum value of vane lift changing quantity per unit rotational angle ($\theta\Delta$) in the expansion section of the inner peripheral surface of the cam ring is 11.4% of a rotational angle ($\theta x$) of one period of the cam configuration, and the region (rotational angle) having a lift increasing amount per unit rotational angle of not less than 5% of the maximum value of vane lift changing quantity per unit rotational angle ($\theta\Delta$) in the expansion section of the inner peripheral surface of the cam ring is 31.2% of a rotational angle ($\theta x$) of one period of the cam configuration.

The construction, operation and advantages of the hydraulic vane pump according to the seventh embodiment will be described in detail with particular reference to the differences with the second embodiment.

Like the above-described second embodiment, the hydraulic vane pump according to the seventh embodiment is used as a balanced-force-type hydraulic vane pump for industrial use. The number of vanes used is eight which is a minimum limit for this type of pump that can be sealed by the vanes inserted in the rotor.

For a limited space available for installation, a fluid tank employed in this embodiment is of such a capacity as to fail to provide a storing time necessary for allowing air bubbles to be eliminated in the fluid. To cope with this, the inner peripheral surface of a cam ring has a cam curve formed thereon and having a configuration expressed by a plurality of equations of higher degree particularly in the expansion section of the cam configuration of the inner peripheral surface of the cam ring as shown in FIG. 4, so that an instantaneous flow produced when the working fluid is discharged will have a waveform intermediate between the waveforms shown in FIGS. 5 and 6.

More specifically, the inner peripheral surface of the cam ring of the hydraulic vane pump of the seventh embodiment has a cam curve shaped such that the ratio of maximum value of vane lift changing quantity per unit rotational angle of a 1/180 period of cam configuration, to the maximum value of vane lift, in the expansion section of the inner peripheral surface of the cam ring is 0.0244, the region having a lift increasing amount per unit rotational angle of not less than 95% of the maximum value of vane lift changing quantity per unit rotational angle ($\theta\Delta$) in the expansion section of the inner peripheral surface of the cam ring is 11.4% of a rotational angle ($\theta x$) of one period of the cam configuration, and the region having a lift increasing amount per unit rotational angle of not less than 5% of the maximum value of vane lift changing quantity per unit rotational angle ($\theta\Delta$) in the expansion section of the inner peripheral surface of the cam ring is 31.2% of a rotational angle ($\theta x$) of one period of the cam configuration.

With the hydraulic vane pump of the seventh embodiment thus arranged, flow and pressure pulsations of the fluid discharged from the hydraulic vane pump can be reduced for thereby preventing the hydraulic system from generating noises and vibrations.

Where the fluid to be sucked into the vane pump has a bulk modulus (Ko) in the range of 100 to 2,000 kgf/cm$^2$, the hydraulic vane pump of the seventh embodiment has better advantages.

Figure 29:
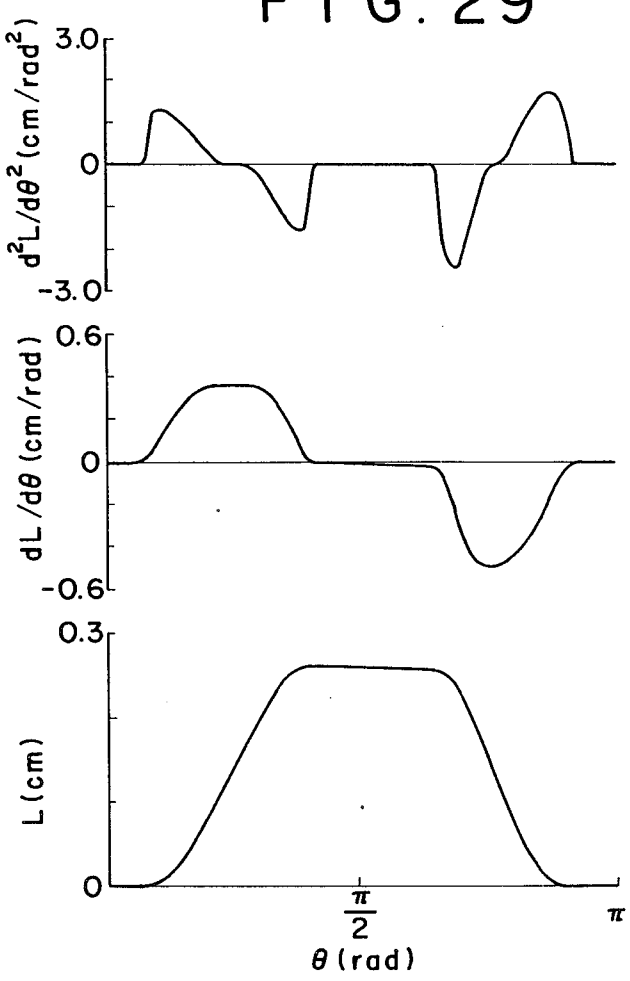
FIGS. 29 and 30 are explanatory of a hydraulic vane pump according to a seventh embodiment of the present invention, FIG. 29 being a set of lift, speed and acceleration diagrams of a cam curve of the pump, and FIG. 30 a diagram showing the waveforms of an instantaneous flow and a discharge pressure of the pump.

A specific example in which the hydraulic vane pump of the seventh embodiment is developed so as to belong also to the third aspect is shown at "7" in the table 1, with its cam configuration illustrated in FIG. 29. The table 1 sets forth major values such as cam configuration and various performances, along with conditions, obtained with a hydraulic vane pump according to the specific example 7.

Figure 30:
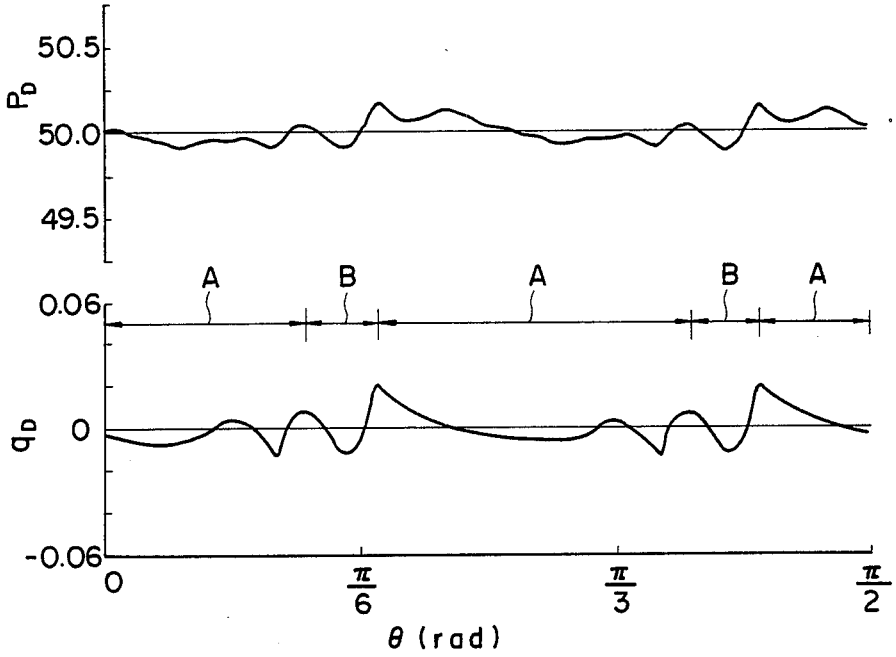

FIG. 30 illustrates the pulsating waveforms of the instantaneous flow and discharge pressure of the hydraulic vane pump according to the specific example 7.

As is apparent from the table 1 and FIG. 30, the example 7 is advantageous in that the vane lift in the maximum lift holding section is reduced to pre-compress the confining vane chamber to reduce or eliminate a large drop of the instantaneous flow waveform in the region B for reducing pressure pulsations mainly of a fluid having a low bulk modulus.

A hydraulic vane pump according to an eighth embodiment belonging to the third aspect of the invention will hereinafter be described with reference to FIGS. 31 through 35.

According to the eighth embodiment, the present invention is applied to a balanced-force-type hydraulic vane pump for automotive use. The number of vanes used is eight which is a minimum limit in this type of hydraulic vane pump. The hydraulic vane pump includes a cam ring having an inner peripheral surface shaped such that the ratio of maximum value of vane lift changing quantity per unit rotational angle of a 1/180 period of cam configuration, to the maximum value of vane lift, in the expansion section of the inner peripheral surface of the cam ring is 0.025, that is, the ratio of a maximum vane lift increase per one degree of the rotational angle of the rotor to the maximum vane lift is 0.025. The region (rotational angle) having a lift increasing amount per unit rotational angle of not less than 95% of the maximum value of vane lift changing quantity per unit rotational angle ($\theta\Delta$) in the expansion section of the inner peripheral surface of the cam ring is 12.8% of a rotational angle ($\theta x$) of one period of the cam configuration, and the region (rotational angle) having a lift increasing amount per unit rotational angle of not less than 5% of the maximum value of vane lift changing quantity per unit rotational angle ($\theta\Delta$) in the expansion section of the inner peripheral surface of the cam ring is 29.9% of a rotational angle ($\theta x$) of one period of the cam configuration. Furthermore, a vane lift reduction, per one radian in the direction of rotation, in the large-arc section has an average percentage of 2.18 (%/rad) with respect to the maximum vane lift, the vane lift reduction being stepwise in the central portion of the maximum lift hoding section.

The construction, operation and advantages of the hydraulic vane pump according to the eighth embodiment will be described in detail with particular reference to the differences with the third embodiment and the features of the configuration of the cam curve on the inner peripheral surface of the cam ring.

Figure 32:
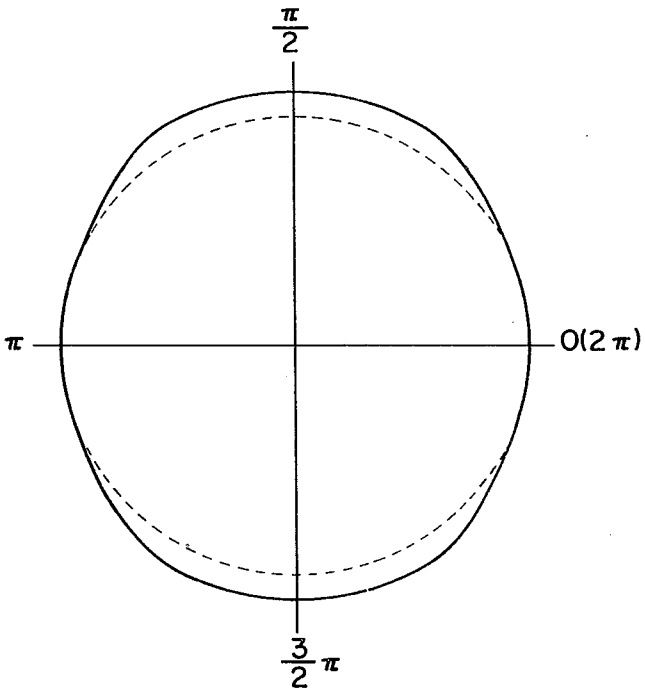
FIGS. 31 through 35 are explanatory of a hydraulic vane pump according to an eighth embodiment of the present invention, FIG. 31 being a set of lift, speed and acceleration diagrams of a cam curve of the pump, FIG. 32 a diagram showing a cam configuration on an inner peripheral surface of a cam ring of the pump, FIG. 33 a diagram showing the waveforms of an instantaneous flow and an discharge pressure of the pump, FIG. 34 a diagram showing the waveforms of an instantaneous flow and a discharge pressure of a first comparative device, and FIG. 35 a diagram showing the waveforms of an instantaneous flow and an discharge pressure of a second comparative device.
Figure 31:
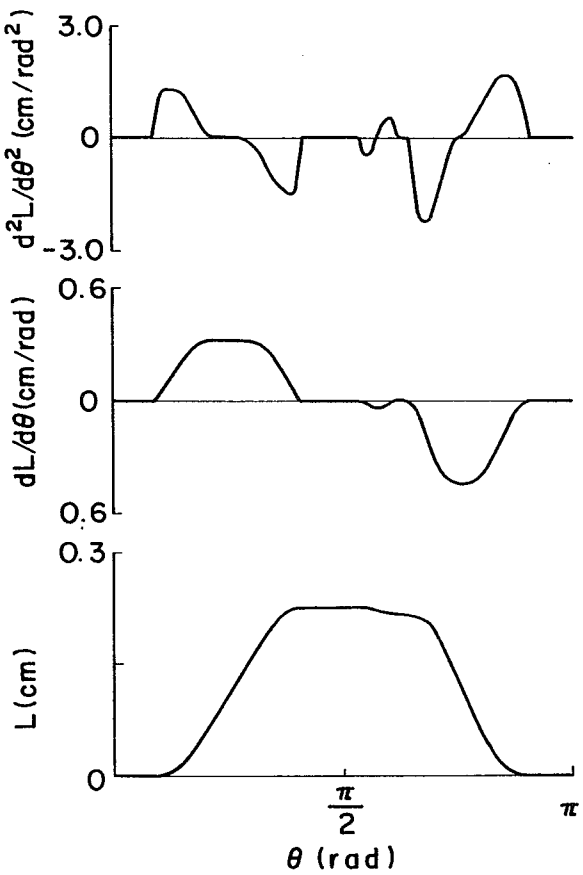
Figure 33:
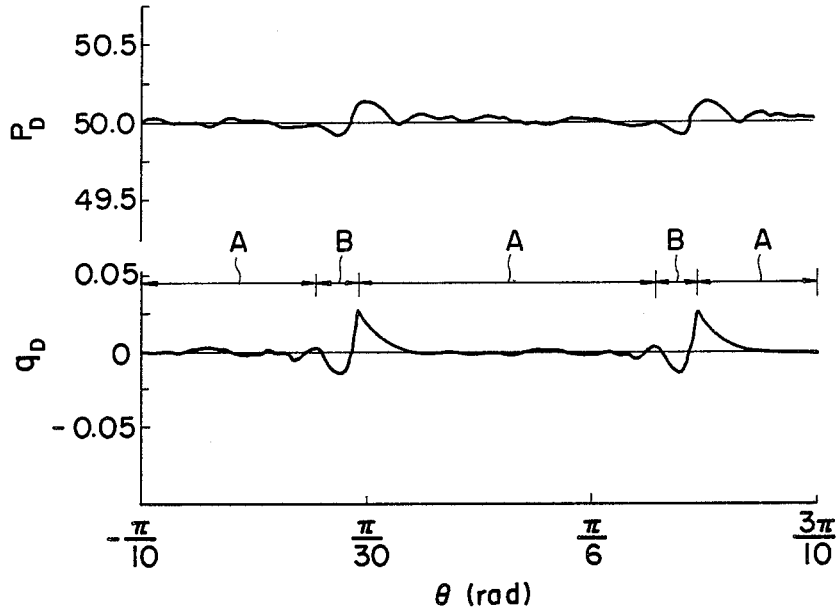

Like the above-described third embodiment, the hydraulic vane pump according to the eighth embodiment is used as a balanced-force-type hydraulic vane pump for use on an automobile under such conditions that the fluid to be sucked into the pump has a bulk modulus of 280 kgf/cm$^2$ representing a relatively small quantity of air bubbles contained in the fluid. In order that an instantaneous flow produced when the fluid is discharged will have the waveform shown in FIG. 6, the inner peripheral surface of a cam ring has a cam curve formed thereon and having a configuration expressed by a plurality of equations of higher degree in the expansion section in the suction region, in which particularly the lift of the vanes is increased, of the cam configuration of the inner peripheral surface of the cam ring as shown in FIG. 4. At the same time, the maximum lift holding section is given a stepped configuration composed of a zero lift reduction section—a lift reduction section—a zero lift reduction section, with the lift difference being 0.06 mm. The cam configuration thus obtained is shown in FIG. 31, and the configuration of the inner peripheral surface of the cam ring is illustrated in FIG. 32. Various performances of the hydraulic vane pump according to the eighth embodiment, along with conditions, are shown in a table 2, and the waveforms of instantaneous flow and discharge pressure pulsations by the hydraulic vane pump of the eighth embodiment are illustrated in FIG. 33.

For comparison purposes, there were constructed a comparative device (1) which is substantially the same as the hydraulic vane pump of the eighth embodiment except that no lift reduction is provided in the large-arc section of the cam curve formed on the inner peripheral surface of the am ring, and another comparative device (2) which has a lift difference of 0.06 mm in the large-arc section as with the eighth embodiment, but the lift reduction is characterized by a constant velocity.

Figure 34:
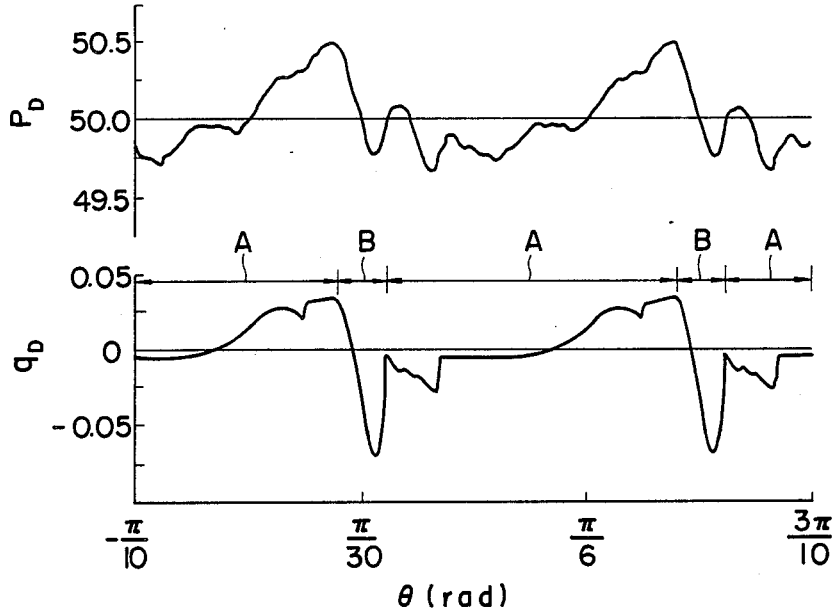
Figure 35:
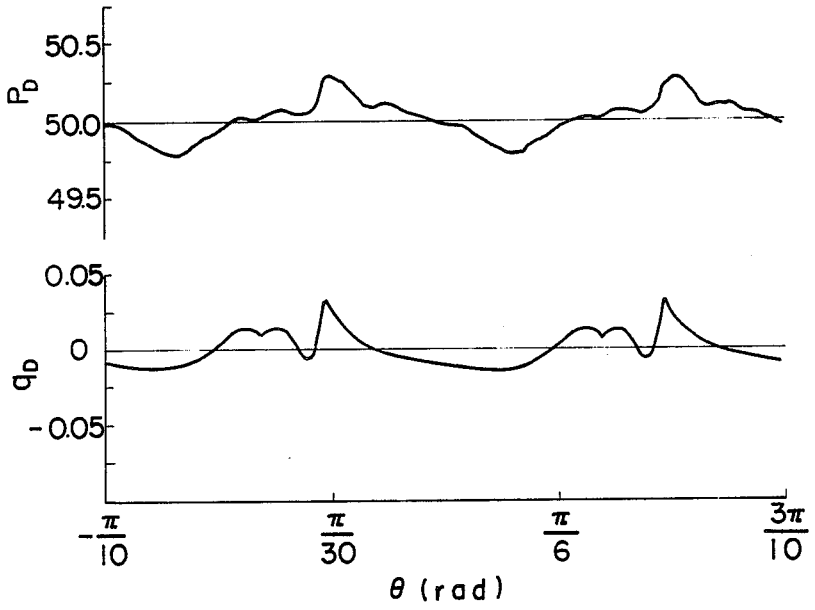

The table 2 also shows various performances of the comparative devices along with conditions, and FIGS. 34 and 35 illustrate the waveforms of instantaneous flow and discharge pressure pulsations by the respective comparative devices.

With the hydraulic vane pump of the eighth embodiment, the central portion of the large-arc section of the cam curve on the inner peripheral surface of the cam ring has a stepwise lift reduction, and flow and pressure pulsations of the fluid discharged from the hydraulic vane pump can be reduced to a large extent even with the minimum limit number of eight vanes employed and the fluid having a low bulk modulus. Therefore, the hydraulic system in which the hydraulic vane pump is incorporated is prevented from producing noise and vibrations.

TABLE 2

| | Device of 8th embodiment | Comparative devices 1 | Comparative devices 2 |
|---|---|---|---|
| RPM (r.p.m.) | | 1,000 | |
| Average pressure (kgf/cm$^2$) | | 50 | |
| Ko (kgf/cm$^2$) | | 280 | |
| $\epsilon$ (%) | 4.21 | 10.29 | 4.57 |
| $\Delta$Pd (kgf/cm$^2$) | 0.25 | 0.80 | 0.50 |

With the comparative device 1 in which no lift reduction is present in the large-arc section, the waveform of the instantaneous flow has large variations in the regions A and B, which affect the waveform of the pulsating pressure to cause large pressure pulsations, with the result that noise and vibration will be induced in a hydraulic system. Where the pulsating pressure waveform is close to a sine waveform as shown in FIG. 34, in particular, more noise and vibration will be generated.

With the comparative device 2 in which the large arc section has the same lift difference as that of the pump of the eighth embodiment, but the lift reduction has a constant-velocity curve, instantaneous flow and discharge pressure pulsations can be rendered smaller due to pre-compression than with the comparative device 1. However, the comparative device 2 fails to provide satisfactory prevention of noise and vibration. As shown in FIG. 35, the discharged fluid flow has a large drop in the region A of the instantaneous flow waveform, and the drop affects the pulsating pressure waveform to cause large pressure pulsations, with the result that noise and vibration will be induced in a hydraulic system.

The hydraulic vane pump according to the eighth embodiment is constructed such that the region A of the instantaneous flow is composed of an initial portion inclined downwardly to the right and a successive portion free from flow pulsations. The central portion of the large-arc section of the cam curve on the inner peripheral surface of the cam ring has a stepwise lift reduction, and hence the hydraulic system in which the hydraulic vane pump is incorporated is prevented from producing noise and vibrations.

The comparative devices 1 and 2 comprise hydraulic vane pumps which belong to the present invention. Where the fluid to be sucked into the pump is of a low bulk modulus, however, the comparative devices 1 and 2 cannot satisfactorily prevent the hydraulic system from producing noise and vibrations therein. Nonetheless, the hydraulic devices belonging to the present invention still have a better ability to prevent noise and vibrations from being generated in the hydraulic system than conventional hydraulic systems. Where the bulk modulus of the fluid to be sucked in the pump is 1,000 kgf/cm$^2$ or higher, preferably 5,000 kgf/cm$^2$ or higher, the comparative device 1 has satisfactory advantages of the present invention.

The present invention can be summarized in an alternative manner as follows:

(1) The cam configuration on the inner peripheral surface of the cam ring is such that the cam curve in the expansion section has a ratio of maximum slanting angle to a slanting angle of a reference cam curve in an expansion section thereof is selected within the range from 0.9 to 1.7.

(2) With a vane pump having four vanes in one period of the cam configuration, the cam configuraton on the inner peripheral surface of the cam ring is such that the ratio of maximum slanting angle to the slanting angle in the expansion section of the reference cam curve is a range of 0.9 to 1.4.

(3) With a vane pump having five vanes in one period on the cam configuration, the cam configuration on the inner peripheral surface of the cam ring is such that the ratio of maximum slanting angle to a slanting angle of a reference cam curve in an expansion section thereof is in a range of 1.2 to 1.7.

Figure 3:
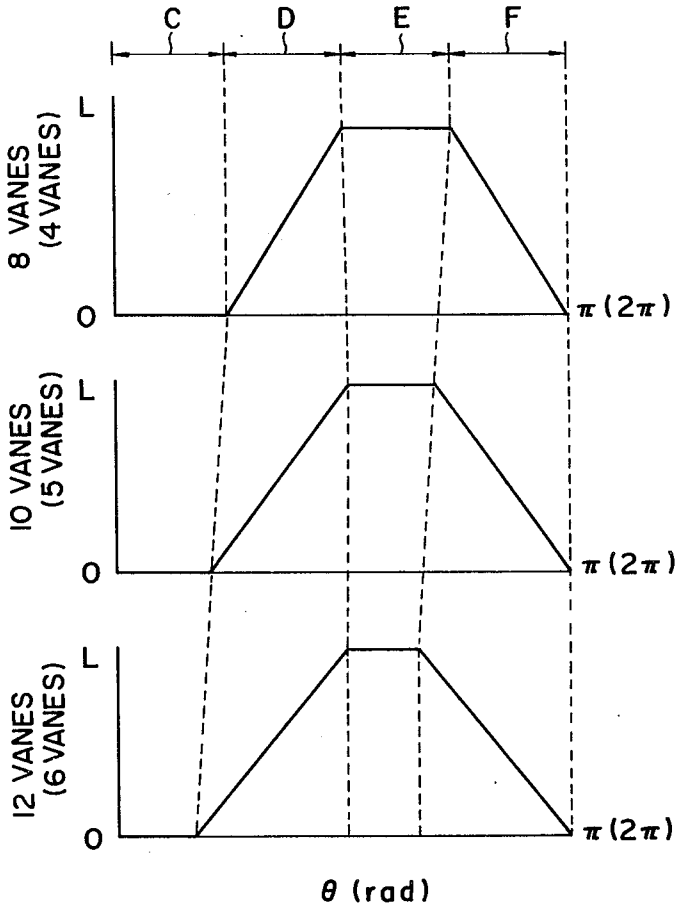
FIG. 3 is a set of lift diagrams of reference cam curves.

According to the present invention, a reference cam curve is defined as follows: As shown in FIG. 3, the reference cam curve is composed of a small-arc section C, an expansion section D, a large-arc section E, and a compression section F. These four sections are arranged in succession in the order of C-D-E-F and jointly for a minimum unit. A cam configuration extending over the minimum unit corresponds to one period of the reference cam curve.

In the range of a rotational angle corresponding to one period of the cam configuration, the section in which a vane will be lifted from the rotor for a minimum (zero or substantially zero) length or distance is equalized to a rotational angle per one pitch of a vane which is derived by dividing $2\pi$ radians by the total number of vanes used, and such section is called the small-arc section (shown at C: minimum lift holding section). The section in which a vane will be lifted from the rotor for maximum length or distance is similarly equalized to a rotational angle of one vane-to-vane pitch which is derived by dividing $2\pi$ radians by the total number of vanes used, and such section is placed centrally in a zone obtained by subtracting the one-pitch rotational angle corresponding to the small-arc section from the rotational angle corresponding to the complete period of the cam configuration. This section is called the large-arc section (shown at E). The expansion section (shown at D) is located between the small-arc section and the large-arc section. In the expansion section, the vanes slide at equal speed against the inner peripheral surface of the cam ring as they are increasingly lifted. The compression section (indicated by F) is located within the rotational angle corresponding to one period of the cam configuration, but precluded from the sections C, E and D. In the compression section, the vanes slide at equal speed against the inner peripheral surface of the cam ring as they are lowered. The compression section is equal to the expansion section. The cam ring configuration thus composed of the small-arc section, the expansion section, the large-arc section, and the compression section is called a reference cam curve or a reference cam configuration. A rotational angle corresponding to the expansion section of the compession section is called a reference cam angle.

The present invention and its aspects cover the ranges shown in the lefthand column of a table 3, and also can cover the ranges in a column X (for no limitation on the number of vanes used, and for five and four vanes in one period of the cam configuration) of the table 3, and the ranges in a column Y (for the same vane number as in the column X) of the table 3 for more pulsation reduction.

The more perferable ranges are shown in a table 4. Adoption of the ranges shown in table 4 will serve to reduce the pulsation still more.

In the foregoing embodiments, the embodiments and examples of the invention have been described as being directed to unbalanded-force-type hydraulic vane pumps having four and five vanes and balanded-force-type hydraulic vane pumps having eight and ten vanes. However, the present invention is in no way limited to the above embodiments and examples, but is also applicable to blanced-force-type hydraulic vane pumps having twelve or more vanes for the same operation and advantages as described above.

TABLE 3

| | The invention and its aspects | X The number of vanes in one period of cam configuration | | | Y The number of vanes in one period of cam configuration | | |
|---|---|---|---|---|---|---|---|
| | | No limit | 5 | 4 | No limit | 5 | 4 |
| Ks | 0.020~0.032 | 0.022~0.032 | 0.024~0.032 | 0.022~0.031 | 0.023~0.032 | 0.027~0.032 | 0.023~0.029 |
| θs95(%) | 5.1~17.5 | 5.7~16.25 | 5.7~10.5 | 9.75~16.25 | 6.0~14.5 | 6.0~9.9 | 10.75~14.5 |
| θs05(%) | 25~35 | 27.5~33.75 | 27.9~33.0 | 27.5~33.75 | 28.2~31.5 | 28.2~31.5 | 28.75~31.25 |
| θs50(%) | 15~22.5 | 16.5~21.6 | 16.5~21.6 | — | 17.4~20.1 | 17.4~20.1 | — |
| Kb(%/rad) | 2~10 | 2.0~9.0 | 2.3~9.0 | 2.0~5.5 | 2.1~8.0 | 2.5~8.0 | 2.1~4.5 |

TABLE 4

| | The invention and its aspects | X The number of vanes in one period of cam configuration | | | Y The number of vanes in one period of cam configuration | | |
|---|---|---|---|---|---|---|---|
| | | No limit | 5 | 4 | No limit | 5 | 4 |
| Ks | 0.020~0.032 | 0.022~0.031 | 0.024~0.031 | 0.022~0.028 | 0.024~0.030 | 0.027~0.030 | 0.024~0.026 |
| θs95(%) | 5.1~17.5 | 6.6~15.0 | 6.6~10.5 | 9.75~15.0 | 7.2~13.0 | 7.2~9.3 | 10.75~13.0 |
| θs05(%) | 25~35 | 27.5~33.0 | 29.4~33.0 | 27.5~32.5 | 29.5~31.5 | 30.0~31.5 | 29.5~31.25 |
| θs50(%) | 15~22.5 | 18.0~21.0 | 18.0~21.0 | — | 18.9~20.1 | 18.9~20.1 | — |
| Kb(%/rad) | 2~10 | 2.0~5.5 | 2.3~5.5 | 2.0~5.5 | 2.1~5.0 | 2.5~4.8 | 2.1~5.0 |

The advantages of the present invention can be enhanced by various combinations of the distance between the inlet and outlet ports, the notch defined in one end of the outlet port closer to the inlet port, and the configuration of the inner peripheral surface of the cam ring.

More specifically, the drop in the region B is produced when the fluid is compressed as it is moved from the inlet port toward the outlet port and the discharged fluid is consumed to compensate for the compressure fluid. The drop can be reduced by giving the cam configuration a prescribed pre-compression coefficient Kb and providing a suitable distance between the inlet and outlet ports and a notch of a suitable length in one end of the outlet port closer to the inlet port. The notch can however be dispensed with if the discharge pressure, the number of RPM, and the fluid compressibility meet certain conditions. The notch is provided for attaining satisfactory low pulsation characteristics in a wide range of operating conditions.

Accordingly, the present invention is rendered more advantageous by providing a cam configuration to reduce pressure pulsations in the region B and then provide a best flow variation pattern in the region A.

Although certain preferred embodiments have been shown and described, it should be understood that many changes and modifications may be made therein without departing from the scope of the appended claims.

What is claimed is:

1. A hydraulic vane pump comprising:

a housing;

a cam ring disposed in the housing and having an inner peripheral surface formed in a cam configuration;

a drive shaft rotatably mounted in said housing;

a rotor connected coaxially to said drive shaft for being driven thereby, said rotor having a plurality of vane slots defined radially in an outer peripheral wall of said rotor and fluid reservoir slots for introducing a fluid provided at the bottom of said vane slots;

a plurality of vanes slidably inserted in said vane slots;

a plurality of vane chambers defined among said rotor, said vanes and said cam ring; and inlet and outlet ports defined in said housing and connected to said vane chambers;

wherein the inner peripheral surface of the cam ring is composed of the following sections per one period of said cam configuration: a small-arc section of minimum value of vane lift changing, an expansion section of increasing vane lifting having a maximum value of vane lift changing quantity at the end thereof, a large-arc section of vane lift in which the vane lift decreases from the maximum value by no more than a slight amount, and a compression section of decreasing vane lifting, wherein the inner peripheral surface of the cam ring is formed to have a ratio being in the range of 0.020 to 0.032 of maximum value of vane lift changing quantity per unit rotational angle of a 1/180 period of cam configuration, to the maximum value of vane lift, in the expansion section of said inner peripheral surface of said cam ring, wherein a region having a lift increasing amount per unit rotational angle of at least 95% of the maximum value of said vane lift changing quantity per unit rotational angle is formed in the range of 5 to 18% of a rotational angle of a period of cam configuration, and wherein a region having a lift increasing amount per unit rotational angle of at least 5% of the maximum value of said vane lift changing quantity per unit rotational angle is formed in the range of 25 to 35% of a rotational angle of a period of cam configuration, thereby reducing pressure variation of discharged fluid flow from said vane pump by properly controlling maximum vane velocity and the followability against the inner peripheral surface of said cam ring in the expansion section of cam configuration.

2. A hydraulic vane pump according to claim 1, wherein a region having a lift increasing amount per unit rotational angle of at least 50% of the maximum value of said vane lift changing quantity per unit rotational angle is formed in the range of 15 to 22.5% of a rotational angle of a period of cam configuration.

3. A hydraulic vane pump according to claim 1, wherein said large-arc section of the cam curve has an average vane lift reduction per radian, in the direction of rotation of said rotor, in the range of 2 to 10% of said maximum value of vane lift.

4. A hydraulic vane pump according to claim 3, wherein said average vane lift reduction is in the range of 2 to 6%.

5. A hydraulic vane pump according to claim 1, wherein four vanes are provided per one period of said cam configuration and said ratio of maximum value of vane lift changing quantity per unit rotational angle of a 1/180 period of cam configuration, to the maximum value of vane lift, in said expansion section is in the range of 0.020 to 0.031.

6. A hydraulic vane pump according to claim 5, wherein a region having a lift increasing amount per unit rotational angle of at least 95% of the maximum value of said vane lift changing quantity per unit rotational angle is formed in the range of 7.5 to 13.75% of a rotational angle of a period of cam configuration, and a region having a lift increasing amount per unit rotational angle of at least 5% of the maximum value of said vane lift changing quantity per unit rotational angle is formed in the range of 25 to 35% of a rotational angle of a period of cam configuration.

7. A hydraulic vane pump according to claim 5, wherein said ratio of maximum value of vane lift changing quantity per unit rotational angle of a 1/180 period of cam configuration, to the maximum value of vane lift, in said expansion section is in the range of 0.022 to 0.031, a region having a lift increasing amount per unit rotational angle of at least 95% of the maximum value of said vane lift changing quantity per unit rotational angle is formed in the range of 9.75 to 16.25% of a rotational angle of a period of cam configuration, and a region having a lift increasing amount per unit rotational angle of at least 5% of the maximum value of said vane lift changing quantity is formed in the range of 27.5 to 33.75% of a rotational angle of a period of cam configuration.

8. A hydraulic vane pump according to claim 7, wherein said large-arc section of the cam curve has an average vane lift reduction per radian, in the direction of rotation of said rotor, in the range of 2.0 to 5.5% of said maximum value of vane lift.

9. A hydraulic vane pump according to claim 7, wherein said ratio of maximum value of vane lift changing quantity per unit rotational angle of a 1/180 period of cam configuration, to the maximum value of vane lift, in said expansion section is in the range of 0.023 to 0.029, a region having a lift increasing amount per unit rotational angle of at least 95% of the maximum value of said vane lift changing quantity per unit rotational angle is formed in the range of 10.75 to 14.5% of a rotational angle of a period of cam configuration, and a region having a lift increasing amount per unit rotational angle of at least 5% of the maximum value of said vane lift changing quantity per unit rotational angle is formed in the range of 28.75 to 31.25% of a rotational angle of a period of cam configuration.

10. A hydraulic vane pump according to claim 9, wherein said large-arc section of the cam curve has an average vane lift reduction per radian, in the direction of rotation of said rotor, in the range of 2.1 to 4.5% of said maximum value of vane lift.

11. A hydraulic vane pump according to claim 1, wherein five vanes are provided per one period of said cam configuration, and said ratio of maximum value of vane lift changing quantity per unit rotational angle of a 1/180 period of cam configuration, to the maximum value of vane lift, in said expansion section is in the range of 0.022 to 0.032.

12. A hydraulic vane pump according to claim 11, wherein a region having a lift increasing amount per unit rotational angle of at least 95% of the maximum value of said vane lift changing quantity per unit rotational angle is formed in the range of 5.7 to 12% of a rotational angle of a period of cam configuration, and a region having a lift increasing amount per unit rotational angle of at least 50% of the maximum value of said vane lift changing quantity per unit rotational angle is formed in the range of 15 to 22.5% of a rotational angle of a period of cam configuration.

13. A hydraulic vane pump according to claim 12, wherein a region having a lift increasing amount per unit rotational angle of at least 50% of the maximum value of said vane lift changing quantity per unit rotational angle is formed in the range of 17.1 to 22.5% of a rotational angle of a period of cam configuration.

14. A hydraulic vane pump according to claim 12, wherein said ratio of maximum value of vane lift changing quantity per unit rotational angle of a 1/180 period of cam configuration, to the maximum value of vane lift, in said expansion section is in the range of 0.024 to 0.032, a region having a lift increasing amount per unit rotational angle of at least 95% of the maximum value of said vane lift changing quantity per unit rotational angle is formed in the range of 5.7 to 10.5% of a rotational angle of a period of cam configuration, and said large-arc section of said cam curve has an average vane lift reduction per radian, in the direction of rotation of said rotor, in the range of 2.3 to 9% of said maxixmum value of vane lift.

15. A hydraulic vane pump according to claim 14, wherein a region having a lift increasing amount per unit rotational angle of at least 50% of the maximum value of said lift changing quantity per unit rotational angle is formed in the range of 16.5 to 21.6% of a rotational angle of a period of cam configuration.

16. A hydraulic vane pump according to claim 15, wherein a region having a lift increasing amount per unit rotational angle of at least 5% of the maximum value of said vane lift changing quantity per unit rotational angle is formed in the range of 27.9 to 33.0% of a rotational angle of a period of cam configuration.

17. A hydraulic vane pump according to claim 14, wherein said ratio of maximum value of vane lift changing quantity per unit rotational angle of a 1/180 period of cam configuration, to the maximum value of vane lift, in said expansion section is in the range of 0.027 to 0.032, a region having a lift increasing amount per unit rotational angle of at least 95% of the maximum value of said vane lift changing quantity per unit rotational angle is formed in the range of 6.0 to 9.9% of a rotational angle of a period of cam configuration, and said large-arc section of the cam curve has an average vane lift reduction per radian, in the direction of rotation of said rotor, in the range of 2.5 to 8.0% of said maximum value of vane lift.

18. A hydraulic vane pump according to claim 17, wherein a region having a lift increasing amount per unit rotational angle of at least 50% of the maximum value of said vane lift changing quantity per unit rotational angle is formed in the range of 17.4 to 20.1% of a rotational angle of a period of cam configuration.

19. A hydraulic vane pump according to claim 18, wherein a region having a lift increasing amount per unit rotational angle of at least 5% of the maximum value of said vane lift changing quantity per unit rotational angle is formed in the range of 28.2 to 31.5% of a rotational angle of a period of cam configuration.

* * * * *

UNITED STATES PATENT AND TRADEMARK OFFICE

CERTIFICATE OF CORRECTION

PATENT NO. : 4,738,603

DATED : Apr. 19, 1988

INVENTOR(S) : Katsuhiko Hattori

It is certified that error appears in the above-identified patent and that said Letters Patent is hereby corrected as shown below:

Title page:

The correct spelling of the inventor's name is as follows:

-- Katsuhiko Hattori --

Signed and Sealed this

Eighteenth Day of October, 1988

*Attest:*

DONALD J. QUIGG

*Attesting Officer*

*Commissioner of Patents and Trademarks*